US010045591B2

(12) United States Patent
Isinhue et al.

(10) Patent No.: US 10,045,591 B2
(45) Date of Patent: Aug. 14, 2018

(54) RETRACTABLE HIGH HEEL FOR SHOES

(71) Applicant: Alexander Isinhue LLC, Claremont, CA (US)

(72) Inventors: Alexander M. Isinhue, Claremont, CA (US); Nathan Alexander Ordonez-Chu, Los Angeles, CA (US); Elyse A. MacNamara, Washington, DC (US)

(73) Assignee: Alexander Isinhue LLC, Claremont, CA (US)

( * ) Notice: Subject to any disclaimer, the term of this patent is extended or adjusted under 35 U.S.C. 154(b) by 0 days.

(21) Appl. No.: 14/527,646

(22) Filed: Oct. 29, 2014

(65) Prior Publication Data

US 2015/0113837 A1 Apr. 30, 2015

Related U.S. Application Data

(60) Provisional application No. 61/897,203, filed on Oct. 29, 2013.

(51) Int. Cl.

| | |
|---|---|
| ***A43B 1/00*** | (2006.01) |
| ***A43B 3/24*** | (2006.01) |
| ***A43B 21/42*** | (2006.01) |
| ***A43B 21/433*** | (2006.01) |

(52) U.S. Cl.

CPC ..... *A43B 21/42* (2013.01); *A43B 1/0054* (2013.01); *A43B 3/246* (2013.01); *A43B 21/433* (2013.01)

(58) Field of Classification Search

CPC ..... A43B 1/0054; A43B 3/24; A43B 3/246; A43B 3/248; A43B 21/42; A43B 21/433; A43B 21/437

USPC ..... 36/34 R, 38, 39, 100

See application file for complete search history.

(56) References Cited

U.S. PATENT DOCUMENTS

| | | | | |
|---|---|---|---|---|
| 2,934,840 | A | 5/1960 | Marion | |
| 3,034,234 | A * | 5/1962 | Portelli | 36/36 R |
| 3,266,177 | A | 8/1966 | Holden | |
| 3,464,126 | A | 9/1969 | Sarkissian | |
| 3,805,418 | A | 4/1974 | Matuka et al. | |

(Continued)

FOREIGN PATENT DOCUMENTS

| | | |
|---|---|---|
| CN | 202858015 U | 4/2013 |
| DE | 202010003087 U1 | 8/2011 |

(Continued)

OTHER PUBLICATIONS

Fickenscher, "High-tech heels transform into flats with the push of a button," New York Post, Nov. 15, 2017 [retrieved Feb. 16, 2018], https://nypost.com/2017/11/15/high-tech-heels-transform-into-flats-with-the-push-of-a-button/, two pages.

*Primary Examiner* — Sharon M Prange

(74) *Attorney, Agent, or Firm* — Davis Wright Tremaine LLP

(57) ABSTRACT

A retractable heel for a shoe is described herein comprising an upper heel body and a retractable lower heel body. The lower heel body is may be placed in at least two configurations. In a first configuration, with the lower heel body retracted, the upper heel body may contact the ground when the shoe is worn. In a second configuration, with the lower heel body not retracted, the upper heel body may not contact the ground when the shoe is worn, being prevented from doing so by the lower heel body.

20 Claims, 33 Drawing Sheets

(56) References Cited

U.S. PATENT DOCUMENTS

| | | | | |
|---|---|---|---|---|
| 4,416,072 | A | 11/1983 | Sarkissian | |
| 4,670,996 | A | 6/1987 | Dill | |
| 4,756,097 | A | 7/1988 | Sanders | |
| 4,910,885 | A * | 3/1990 | Hsieh | 36/37 |
| 5,282,327 | A | 2/1994 | Ogle | |
| 5,309,651 | A * | 5/1994 | Handel | 36/100 |
| 5,347,730 | A | 9/1994 | Rodriguez | |
| 5,524,365 | A | 6/1996 | Goldenberg | |
| 6,021,586 | A * | 2/2000 | Bucalo et al. | 36/42 |
| 7,877,902 | B2 * | 2/2011 | Pieriboni | 36/100 |
| 8,281,503 | B2 * | 10/2012 | Savill, Jr. | 36/100 |
| 8,322,053 | B2 * | 12/2012 | Handel et al. | 36/100 |
| 8,453,351 | B1 | 6/2013 | Hale | |
| 2008/0184598 | A1 * | 8/2008 | Handel et al. | 36/100 |
| 2010/0083537 | A1 * | 4/2010 | Wierda et al. | 36/100 |
| 2010/0139123 | A1 | 6/2010 | Alan et al. | |
| 2012/0055048 | A1 * | 3/2012 | Haupt | A43B 3/24 36/34 R |
| 2012/0085000 | A1 * | 4/2012 | Alaimo | 36/100 |
| 2012/0174435 | A1 * | 7/2012 | Ruano Cerdan et al. | 36/42 |
| 2015/0096197 | A1 * | 4/2015 | Salinas | 36/100 |

FOREIGN PATENT DOCUMENTS

| | | | |
|---|---|---|---|
| DE | 102011108131 | A1 | 1/2013 |
| EP | 1453393 | A1 | 9/2004 |
| EP | 1871190 | A1 | 1/2008 |
| EP | 2143355 | A1 | 1/2010 |
| EP | 2454962 | A1 | 5/2012 |
| WO | 03049567 | A1 | 6/2003 |
| WO | WO 2006037143 | A1 * | 4/2006 |
| WO | 2006113574 | A1 | 10/2006 |

* cited by examiner

RETRACTABLE HIGH HEEL FOR SHOES

CROSS-REFERENCE TO RELATED APPLICATIONS

This application claims priority to and incorporates by reference for all purposes the full disclosure of U.S. Provisional Patent Application No. 61/897,203, filed on Oct. 29, 2013, entitled "RETRACTABLE HIGH HEEL FOR SHOES."

BACKGROUND

The selection of which shoe to wear in a particular circumstance is frequently determined by the height of the heel of the shoe or by the style of the shoe heel. Shoes having low or wide heels are generally selected to provide comfort and ease of mobility. For example, a person may select a shoe with low or wide heels when having to walk a long distance or when having to walk over a particular terrain surface (e.g., rough ground, stairs, or hills). Alternatively, shoes having higher or narrower heels are generally selected for formal events, work environments, or fashion reasons. Such shoes with high heels may be uncomfortable for the wearer after prolonged use, may be unstable on difficult terrain surfaces, or may lead to injuries or to repetitive stress injuries. A wearer may choose to carry multiple pairs of shoes such as, for example, a utility pair for walking and a fashionable pair for work, but it can be difficult for a wearer to transport the multiple pairs and to change shoes when needed.

BRIEF SUMMARY

Embodiments described herein provide a retractable heel for a shoe comprising an upper heel body that is connected to a heel portion of a shoe and a lower heel body that is connected to the upper heel body. The retractable heel (also referred to herein as an "adjustable heel"), may allow a wearer to alter the height of the heel by placing the lower heel body into different configurations. For example, the lower heel body of a retractable heel may be placed in a non-retracted, or "high heel" position when the wearer of the shoe is at a formal event, is in a professional environment, or wishes to wear the higher heel for fashion reasons. The retractable heel may be secured in the non-retracted position using embodiments of the present disclosure. When the wearer of the shoe wishes to adjust the retractable heel to a retracted, or "low heel" position, the lower heel body can be released from the secured non-retracted position and secured in the retracted position, thereby providing a more stable heel for the wearer.

The following detailed description together with the accompanying drawings will provide a better understanding of the nature and advantages of the present invention.

BRIEF DESCRIPTION OF THE FIGURES

Various embodiments in accordance with the present disclosure will be described with reference to the drawings, in which.

DETAILED DESCRIPTION

Figure 1:
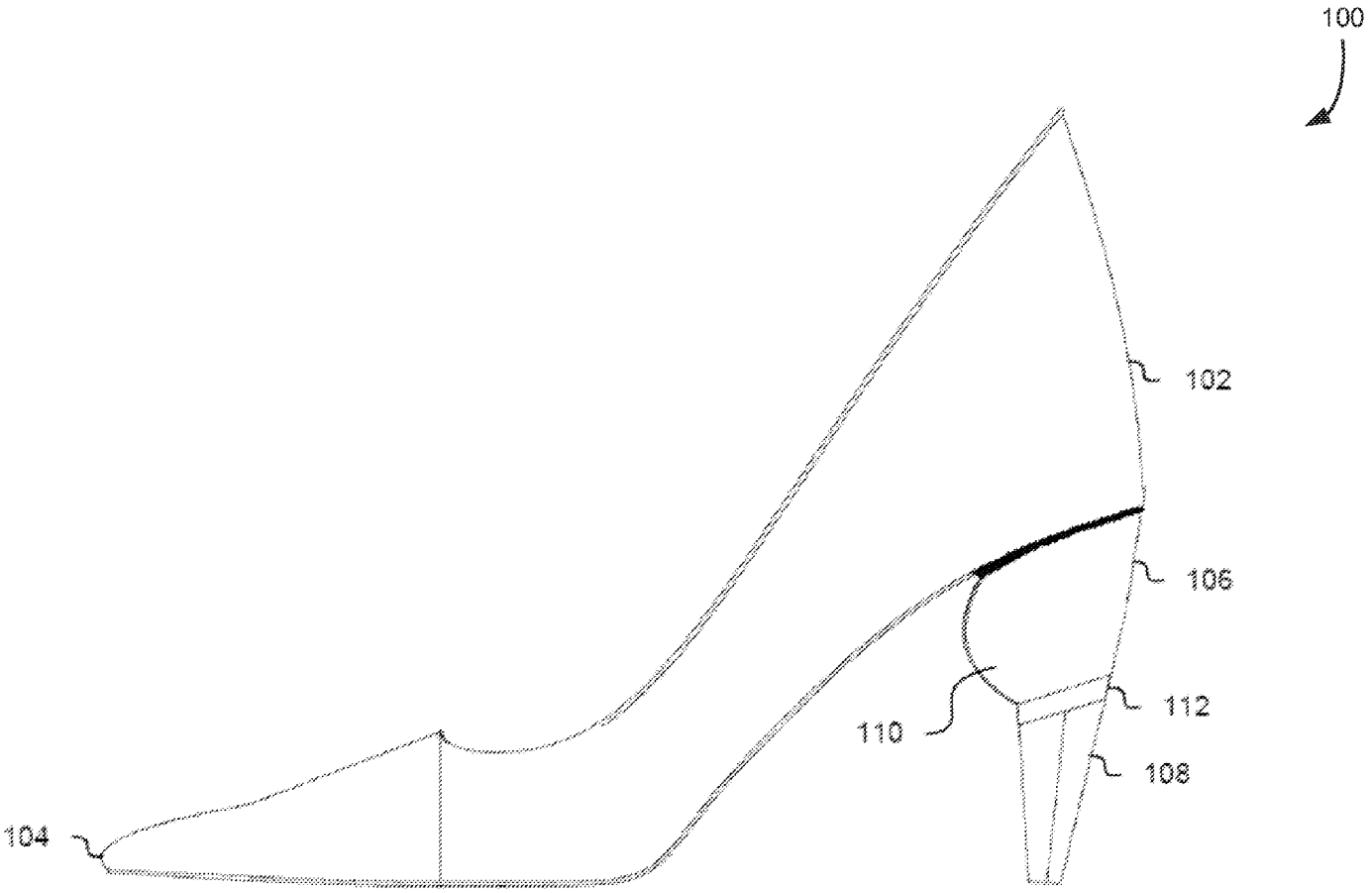
FIG. 1 illustrates a side view of a shoe with a retractable heel in accordance with an embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments described and suggested herein include mechanisms providing a retractable heel for shoes. A person who wears shoes with heels (also referred to herein as a "shoe wearer" or more simply as a "wearer") may desire different heel heights for those shoes based on changing conditions. For example, a wearer may desire a higher heel for more formal occasions and a lower heel for walking across a difficult terrain surface or over long distances. Wearing a shoe with a lower heel, when a higher heel would be considered more appropriate, may violate rules of etiquette or decorum, and may also lead to social disapprobation. Wearing a shoe with a higher heel, when a lower heel would be considered more appropriate, may be unsafe and may lead to injuries including, but not limited to, repetitive stress injuries.

A wearer may carry multiple pairs of shoes to accommodate changing conditions, but carrying multiple pairs of shoes to accommodate changing conditions may be awkward, inconvenient, or cumbersome. A shoe with a retractable heel may allow the wearer to quickly and safely adapt the heel height for use in changing conditions. For example, a wearer may start in the morning with the retractable heel placed in a retracted position for a walk down stairs and through city streets to a bus stop. The wearer may then place the retractable heel in a non-retracted position while at work. The wearer may next place the retractable heel in the retracted position for a walk to a dinner party and may finally place the retractable heel back in the non-retracted position for remainder of the evening.

A mechanism for a retractable heel (also referred to herein as an "adjustable heel") for a shoe is described herein. A retractable heel may comprise an upper heel body that is attached to the heel portion of the shoe (i.e., at the back portion of the shoe, away from the toes of the wearer when the shoe is worn and close to the heel of the wearer when the shoe is worn) and a lower heel body that is located at a lower part of the upper heel body (i.e., opposite to where the upper heel body is attached to the shoe). The upper heel body may include a circular indentation within the upper heel body configured to accept the placement of a circular disk within the circular indentation and also configured to allow the rotation of the circular disk within the circular indentation. For example, the inner radius of the circular indentation may be approximately the same as, but slightly larger than, the outer radius of the circular disk such that the circular disk may be retained within the circular indentation but may also rotate within the circular indentation. It should be noted that while a circular disk within a circular indentation is described herein, any suitable pivoting connector within a pivot indentation that is configured to allow the lower heel body to pivot and/or otherwise be retracted in order that the lower portion of the upper heel body may come into contact with the ground may be substituted for the circular disk.

The circular disk may be configured with a cutout portion that is configured to accept a connector bar and that is further configured to allow the connector bar to move within the cutout portion. In some embodiments, the cutout portion may be configured with one or more cutout sub-portions of differing configurations such as those described herein. The rotation of the circular disk thus configured with a connector bar may cause the pivoting of the connector bar as the circular disk rotates. The cutout portion may also be configured to prevent the connector bar from moving fully through the circular disk based on the shape of the connector bar and/or on the shape of the cutout portion. The cutout portion may also be configured to accept one or more compressible springs that, when in an expanded (or uncompressed) configuration, press against an upper portion of the connector bar and cause at least a portion of the upper portion of the connector bar to extend above (or beyond) the outer radius of the circular disk. When in a compressed configuration when, for example, the connector bar is pulled down through the circular disk, the springs may allow the upper portion of the connector bar to retract within the outer radius of the circular disk.

The circular indentation may be configured with one or more slots (also referred to herein as "retention slots") placed on the inner radius of the circular indentation. The one or more slots may correspond to one or more positions as described herein (e.g., retracted, non-retracted, etc.). The one or more slots may be configured to accept the upper portion of the connector bar so that when the one or more compressible springs are in an uncompressed configuration, the upper portion of the connector bar may extend into one of the one or more slots. Extending the upper portion into one of the one or more slots may prevent the circular disk from rotating and thus, prevent the connector bar from pivoting. Conversely, when the one or more compressible springs are in a compressed position, the upper portion of the connector bar may be retracted within the circular disk, thereby allowing the circular disk to rotate and the connector bar to pivot.

The circular indentation may also be configured with a pivot slot that is configured to allow the connector bar to freely pivot when not otherwise restricted by the one or more retention slots. The pivot slot may also be configured to restrict the motion of the connector bar at certain limits of motion. The lower heel body may be attached to the connector bar so that the lower heel body may slide as the connector bar slides and/or may pivot as the connector bar pivots.

The mechanism described herein may be used to allow the lower heel body to be placed in one or more orientations (or locations). For example, the lower heel body may be placed in a non-retracted position by first pulling on the lower heel body to compress the one or more compressible springs and thus to slide the connector bar to a position where the upper portion of the connector bar is disengaged from the one or more retention slots and is retracted within the outer radius of the circular disk. The circular disk may then be rotated by pivoting the lower heel body (and thus the connector bar) until the lower heel body is in a non-retracted position. The lower heel body may then be released, causing the compressible springs to expand and causing the connector bar to extend into the retention slot of the one or more retention slots that corresponds to the non-refracted position. The compressible springs may then expand, providing a resistive force to retain the connector bar in the retention slot. The lower heel body may also be placed in a retracted position by repeating the above procedure and pivoting the lower heel body so that the connector bar extends into the retention slot of the one or more retention slots that corresponds to the retracted position. In an embodiment, the resistive force to retain the connector bar in the retention slot may be provided by, for example, one or more magnets located within the retention slot, which may attract a corresponding magnet and/or metallic element on the end of connector bar. The lower heel body may be pulled away, thus disengaging the one or more magnets and allowing the lower heel body to be pivoted to a different position. As may be contemplated, the methods of providing resistive force to retain the connector bar in a retention slot described herein are merely illustrative examples and other such methods of providing resistive force to retain the connector bar in a retention slot may be considered as within the scope of the present disclosure.

FIG. 1 illustrates a side view 100 of a shoe with a retractable heel in accordance with an embodiment. FIG. 1 illustrates a shoe with the retractable heel in a non-retracted position. The shoe illustrated in FIG. 1 comprises a heel portion 102 and a toe portion 104 with a retractable heel 106 attached to the shoe at the heel portion 102. The retractable heel 106 illustrated in FIG. 1 comprises an upper heel body 110 and a lower heel body 108, with the lower heel body attached to the upper heel body using a mechanism such as one of the one or more mechanisms described herein. The retractable heel 106 illustrated in FIG. 1 includes an upper heel striking surface 112 at the lower portion of the upper heel body 110 that is configured to contact the ground when the lower heel body 108 is in a retracted position and that is prevented from contacting the ground when the lower heel body 108 is in a non-refracted position as illustrated in FIG. 1. In some embodiments, the upper heel striking surface 112 may not be visible when the lower heel is in a non-retracted position. The upper heel striking surface 112 may also be configured to provide additional traction and/or stability for the wearer when the lower heel body 108 is in a retracted position and may include an upper heel striking surface pad as described herein below.

Figure 2:
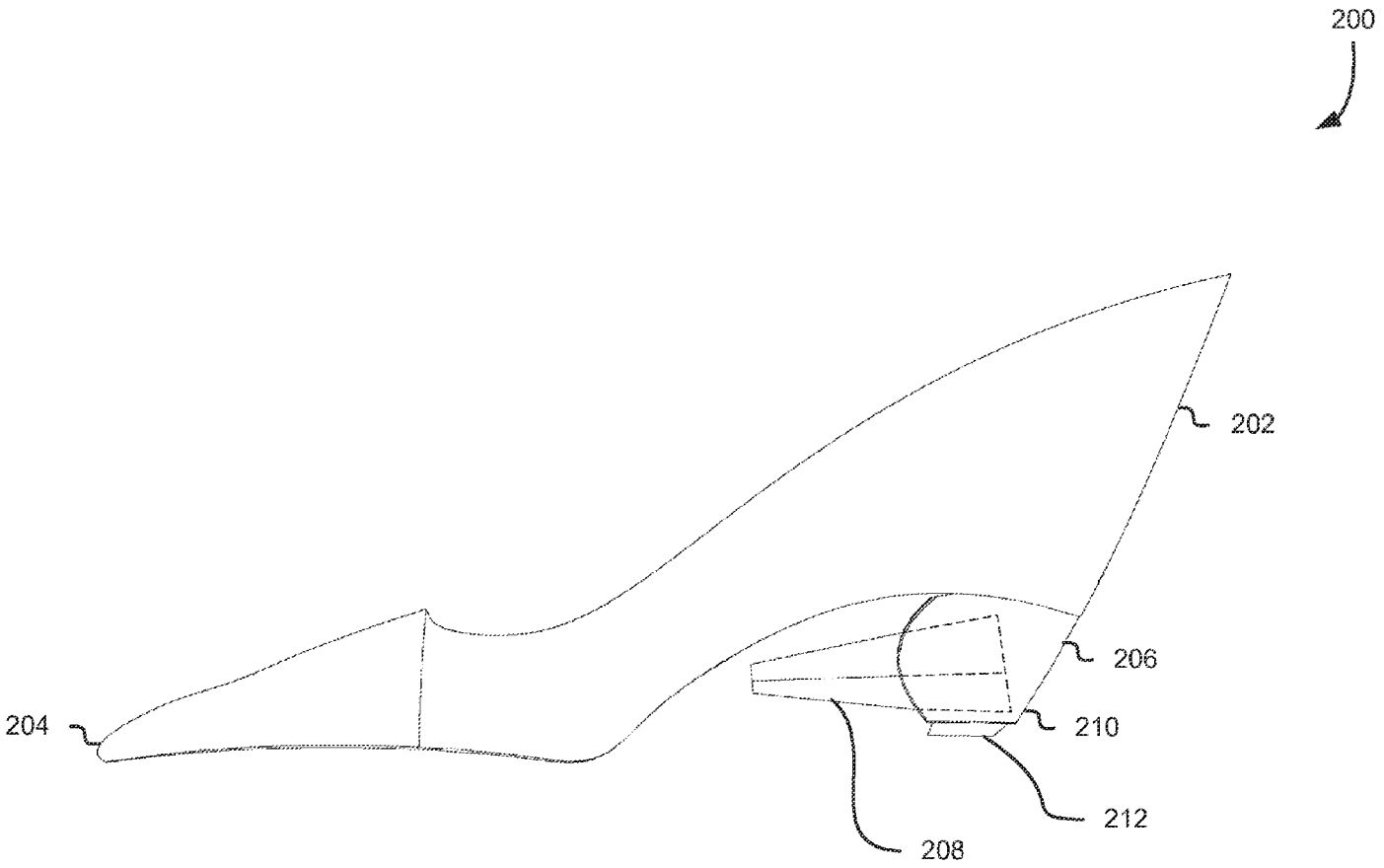
FIG. 2 illustrates a side view of a shoe with a retractable heel in a refracted position in accordance with an embodiment.

FIG. 2 illustrates a side view 200 of a shoe with a retractable heel as described in connection with FIG. 1 and in accordance with an embodiment. FIG. 2 illustrates a shoe with the retractable heel in a retracted position. The shoe illustrated in FIG. 2 comprises a heel portion 202 and a toe portion 204 with a retractable heel 206 attached to the shoe at the heel portion 202. The retractable heel 206 illustrated in FIG. 2 comprises an upper heel body 210 and a lower heel body 208, with the lower heel body 208 attached to the upper heel body 210 using a mechanism such as one of the one or more mechanisms described herein. The retractable heel 206 illustrated in FIG. 2 includes an upper heel striking surface 212 at the lower portion of the upper heel body 210 as described herein in connection with FIG. 1.

Figure 3:
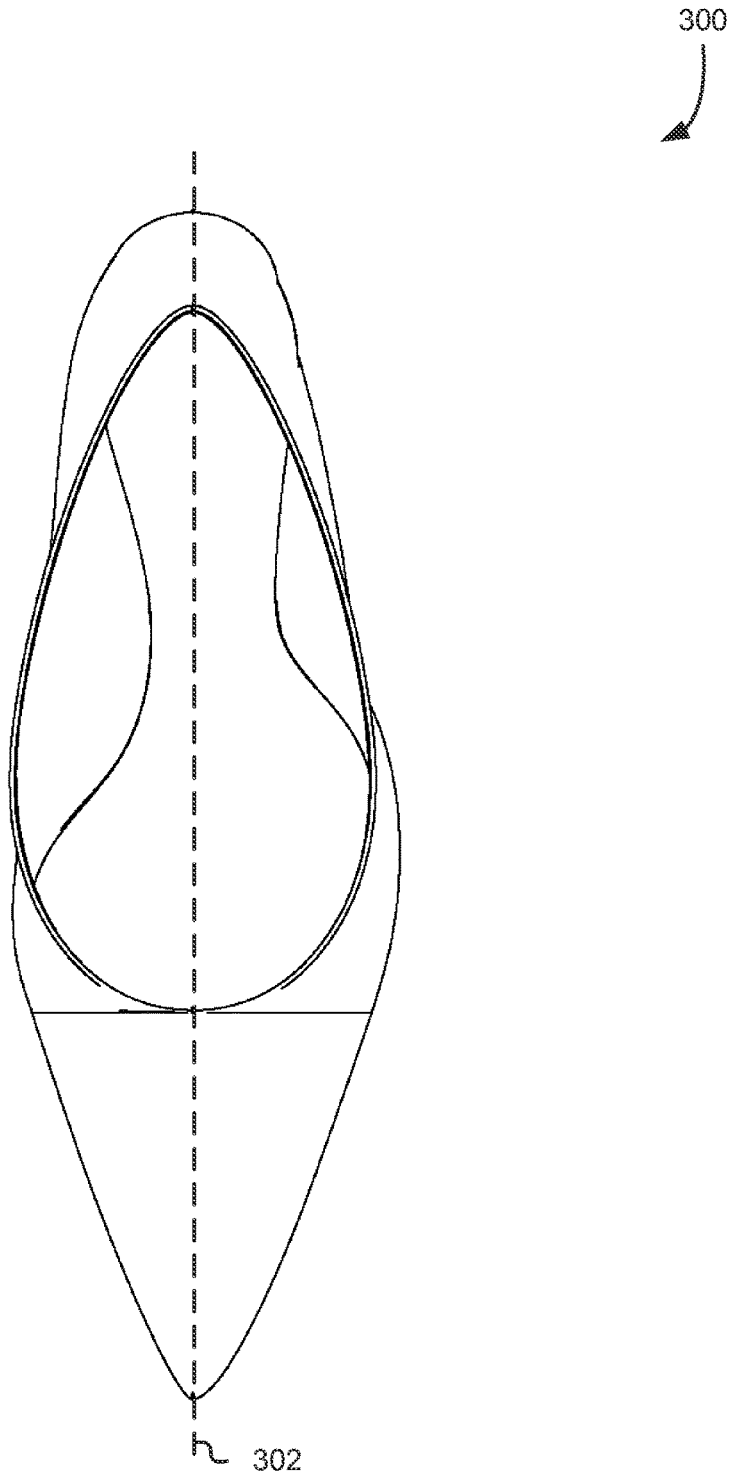
FIG. 3 illustrates a top view of a shoe with a retractable heel including a cross-section indicator in accordance with an embodiment.

FIG. 3 illustrates a top view 300 of a shoe with a retractable heel as described in connection with FIG. 1 and in accordance with an embodiment. FIG. 3 illustrates a cross-section indicator 302 (the dashed line) which is used in connection with the description of FIGS. 4 to 6. It should be noted that, as used herein unless otherwise stated or made clear by context, directional terms such as front, back, left, right, top, bottom, up, down, and other such terms are references with respect to the shoe and/or the wearer of the shoe. Front refers to the front of the shoe, which is toward the toe of the shoe and/or the toes of the wearer. Back refers to the back of the shoe, which is toward the heel of the shoe and/or the heel of the wearer. Similarly, left refers to the wearers left, down is toward the ground, and so on.

Figure 4:
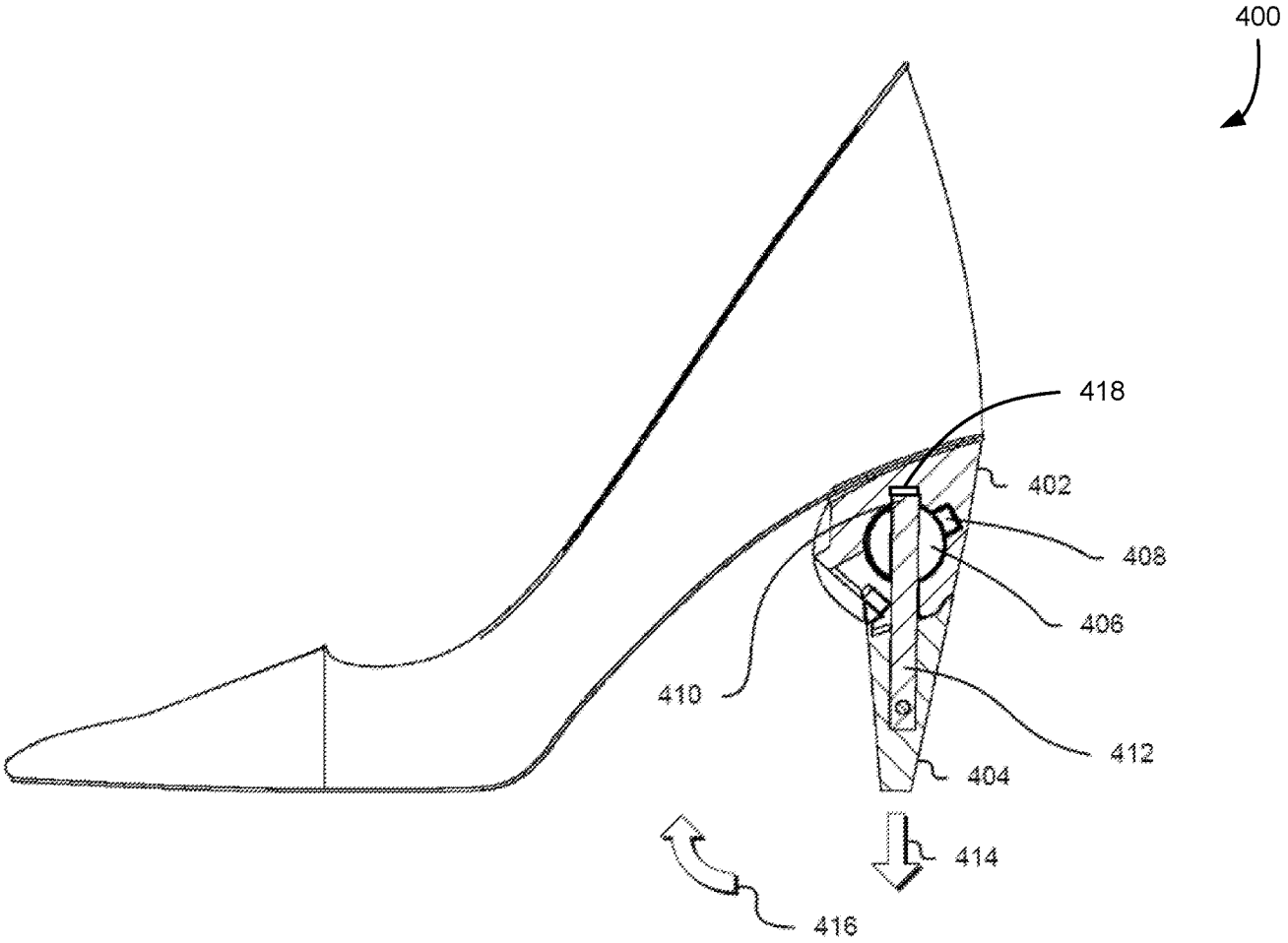
FIG. 4 illustrates a side view of a cross-section of a shoe with a retractable heel in a non-retracted position in accordance with an embodiment.

FIG. 4 illustrates a side view 400 of a cross-section of a shoe with a retractable heel as described in connection with FIG. 1 and in accordance with an embodiment. FIG. 4 illustrates the shoe with the retractable heel in a non-retracted position. The shoe illustrated in FIG. 4 is a cross-section view with the cross-section at the cross-section indicator 302 illustrated in FIG. 3. The retractable heel for a shoe may include an upper heel body 402 and lower heel body 404 that may be placed in multiple positions. The upper heel body 402 and the lower heel body 404 may be connected to form a heel. The upper heel body 402 may be attached to the heel portion of the shoe, away from the toes of the wearer when the shoe is worn and close to the heel of the wearer when the shoe is worn. The lower heel body 404 may be located at a lower part of the upper heel body 402, opposite to where the upper heel body is attached to the shoe as illustrated in FIG. 4.

The upper heel body 402 may include a circular indentation within the upper heel body 402 configured to accept the placement of a circular disk 406 within the circular indentation and also configured to allow the rotation of the circular disk 406 within the circular indentation. The circular indentation may be configured to allow the rotation of the circular disk 406 by, for example, configuring the inner radius of the circular indentation to be approximately the same as, but slightly larger than, the outer radius of the circular disk 406. Accordingly, the circular disk 406 may be retained within the circular indentation but may also rotate within the circular indentation.

The circular disk 406 may be configured with a cutout portion that is configured to accept a connector bar 412 and that is further configured to allow the connector bar 412 to move within the cutout portion in the circular disk 406. As illustrated in FIG. 4, the connector bar 412 may pivot around a point approximately at the center of rotation of the circular disk 406 as the circular disk 406 rotates. The cutout portion of the circular disk 406 may also be configured to prevent the connecting 412 bar from moving fully through the circular disk 406. For example, the connector bar 412 may have a narrow portion and a portion that is wider in one or more dimensions (also referred to herein as one or more axes). The wider portion of the connector bar 412 may be prevented from moving fully through the circular disk 406 in a direction indicated by the arrow 414 because, for example, the cutout portion through the circular disk 406 may be narrower than the wider portion of the connector bar 412 along the one or more dimensions (i.e., width, depth, height, etc.).

The cutout portion in the circular disk 406 may also be configured to accept one or more compressible springs (such as the compressible spring 1012 described in connection with FIG. 10 and in accordance with an embodiment) that, when in an uncompressed configuration (e.g., the partially compressed configuration 3304 or the fully compressed configuration 3306 described in connection with FIG. 33), press against an upper portion of the connector bar 412 and cause at least a portion of the upper portion of the connector bar 412 to extend above (or beyond) the outer radius of the circular disk 406. When the compressible spring is in a compressed configuration (e.g., the partially compressed configuration 3304 or the non-compressed configuration 3302 described in connection with FIG. 33) because, for example, the connector bar 412 is pulled down through the circular disk 406 in a direction indicated by the arrow 414, the one or more compressible springs may allow the upper portion of the connector bar 412 to retract within the outer radius of the circular disk 406.

The circular indentation within the upper heel body 402 may also be configured with one or more retention slots placed on the inner radius of the circular indentation within the upper heel body 402 such as the first retention slot 408 and the second retention slot 410 illustrated in FIG. 4. The one or more retention slots may correspond to one or more positions as described herein (e.g., retracted, non-retracted, etc.). The one or more retention slots may be configured to accept the upper portion of the connector bar 412 such that, when the one or more compressible springs are in an uncompressed configuration, the upper portion of the connector bar 412 may extend into one of the one or more retention slots. For example, the second retention slot 410 is configured to accept the upper portion of the connector bar 412 when the retractable heel is in a non-retracted position.

By extending the upper portion into a retention slot such as the second retention slot 410 as illustrated in FIG. 4, the circular disk 406 may be prevented from rotating and thus, the connector bar 412 may be prevented from pivoting. Conversely, if the lower heel body 404 is pulled in the direction of the arrow 414, the one or more compressible springs may be in a compressed position, the upper portion of the connector bar 412 may be retracted within the circular disk 406, the circular disk 406 may thus rotate and the connector bar 412 may pivot in the direction indicated by the arrow 416. In some embodiments, the circular indentation within the upper heel body 402 may also be configured with a pivot slot (such as the pivot slot 1022 described in connection with FIG. 10 and in accordance with an embodiment) that is configured to allow the connector bar 412 to freely pivot when not otherwise restricted by the one or more retention slots. The pivot slot may also be configured to restrict the motion of the connector bar 412 at certain limits of motion. The limits of motion may be based at least in part on one or more of the one or more positions described herein.

The lower heel body 404 illustrated in FIG. 4 is in a non-retracted position. The lower heel body 404 may be placed in a retracted position by, for example, first pulling on the lower heel body 404 in the direction indicated by the arrow 414 to cause the connector bar 412 to slide to a position where the upper portion of the connector bar 412 is disengaged from the second retention slot 410 and is retracted within the outer radius of the circular disk 406. The circular disk 406 may then be rotated by pivoting the lower heel body 404 and the connector bar 412 in the direction indicated by the arrow 416. When the lower heel body is in a non-retracted position (as illustrated herein in FIGS. 5 and 6), the lower heel body 404 may then be released, causing the connector bar 412 to extend into the first retention slot 408, securing the lower heel body 404 in a retracted position. As described above, the retention slot 410 has one or more magnets 418 located within the retention slot. The one or more magnets 418 may attract a corresponding magnet and/or metallic element on the end of connector bar 412 to provide the resistive force to retain the connector bar in the retention slot.

Figure 5:
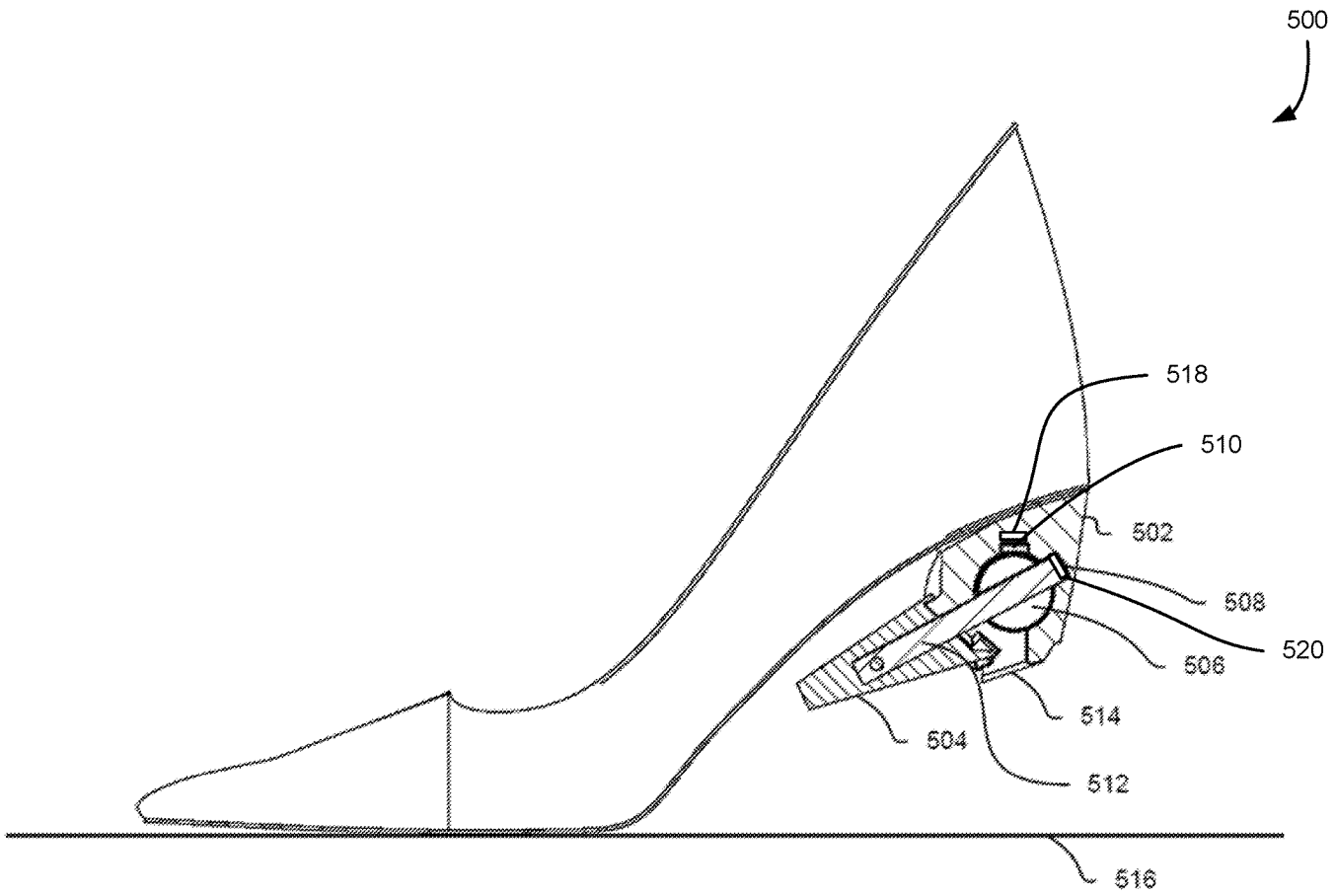
FIG. 5 illustrates a side view of a cross-section of a shoe with a retractable heel in a retracted position in accordance with an embodiment.
Figure 6:
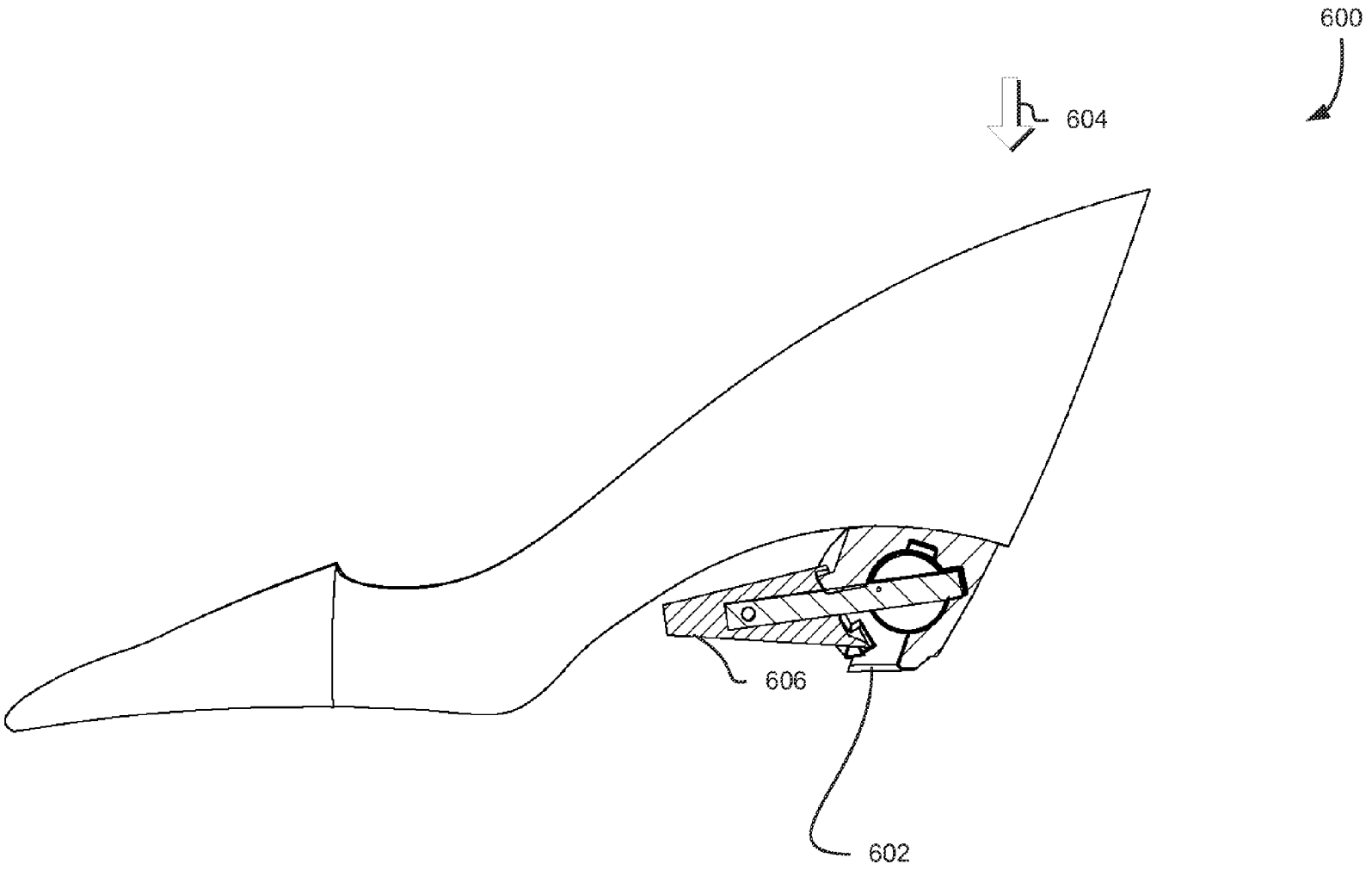
FIG. 6 illustrates a side view of a cross-section of a shoe with a retractable heel in a retracted position in accordance with an embodiment.

FIGS. 5 and 6 illustrate side views of a cross section of a shoe with a retractable heel as described in connection with FIG. 1 and in accordance with an embodiment. FIGS. 5 and 6 illustrate the retractable heel in a retracted position.

FIG. 5 illustrates a side view 500 of a cross-section of a shoe with a retractable heel as described in connection with FIG. 1 and in accordance with an embodiment. FIG. 5 illustrates the shoe with the retractable heel in a retracted position and with the shoe in a natural (i.e., non-deformed) shape. FIG. 6 illustrates a side view 600 of a cross-section of a shoe with a retractable heel as described in connection with FIG. 1 and in accordance with an embodiment. FIG. 6 illustrates the shoe with the retractable heel in a retracted position and with the shoe in a deformed shape.

As illustrated in FIG. 5, and as a result of the operations described in connection with FIG. 4, the lower heel body 504 and the connector bar 512 may have been pivoted with the rotation of the circular disk 506 to the retracted position as described herein. The lower heel body 504 may have been released from a retention slot 510 allowing the connector bar 512 to extend into the retention slot 508 in the upper heel body 502, corresponding to the retracted position. As illustrated in FIG. 5, the shoe is in a non-deformed shape and the upper heel striking surface 514 may not be in direct contact with the terrain surface 516, but may be configured to contact the terrain surface 516 when the shoe is in a deformed shape as described herein below. As described above, the retention slot 508 may have one or more magnets 518 located within the retention slot. The retention slot 510 may also have one or more magnets 520 located within the retention slot. The one or more magnets 518 may attract a corresponding magnet and/or metallic element on the end of connector bar 512 to provide the resistive force to retain the connector bar in the retention slot as described above.

FIG. 6 illustrates the shoe in a deformed shape. The deformed shape may result if, for example, the shoe is worn and pressure from the weight of the wearer is applied in the direction indicated by the arrow 604. The shoe may be deformed because of the materials used for construction of the shoe, or because of a hinging mechanism built into the shoe, or because of the shape of the shoe, or because of a combination of these and/or other such factors. For example, a shoe body made of soft materials such as leather or cloth may naturally assume the deformed shape (i.e., may allow the upper heel body to evenly contact the ground) when worn with the retractable heel in a retracted position. In some embodiments, the upper heel body striking surface may be cut at an angle such that, when the retractable heel is in a retracted position and the shoe is in a deformed shape, the upper heel body striking surface contacts the ground evenly (i.e., the upper heel body striking surface contacts the ground in a configuration where it is parallel to the ground). In some embodiments, a shoe may be shaped so that little and/or no deformation is required to allow the upper heel body to evenly contact the ground evenly, when the shoe is worn with the retractable heel in a refracted position. For example, the upper heel striking surface 602 may be configured to evenly contact the ground when the lower heel body is in a retracted position without requiring deformation of the shoe because of, for example, the angle that of the upper heel body striking surface as described herein. As may be contemplated, the deformed shape of the shoe illustrated in FIG. 6 is merely an example and other deformations of the shape of the shoe that may allow the upper heel striking surface 602 to evenly contact the ground when the lower heel body 606 is in a retracted position may be considered within the scope of the present disclosure.

FIGS. 7 to 11 illustrate views of a retractable heel for use with a shoe with a retractable heel as described in connection with FIG. 1 and in accordance with an embodiment.

Figure 7:
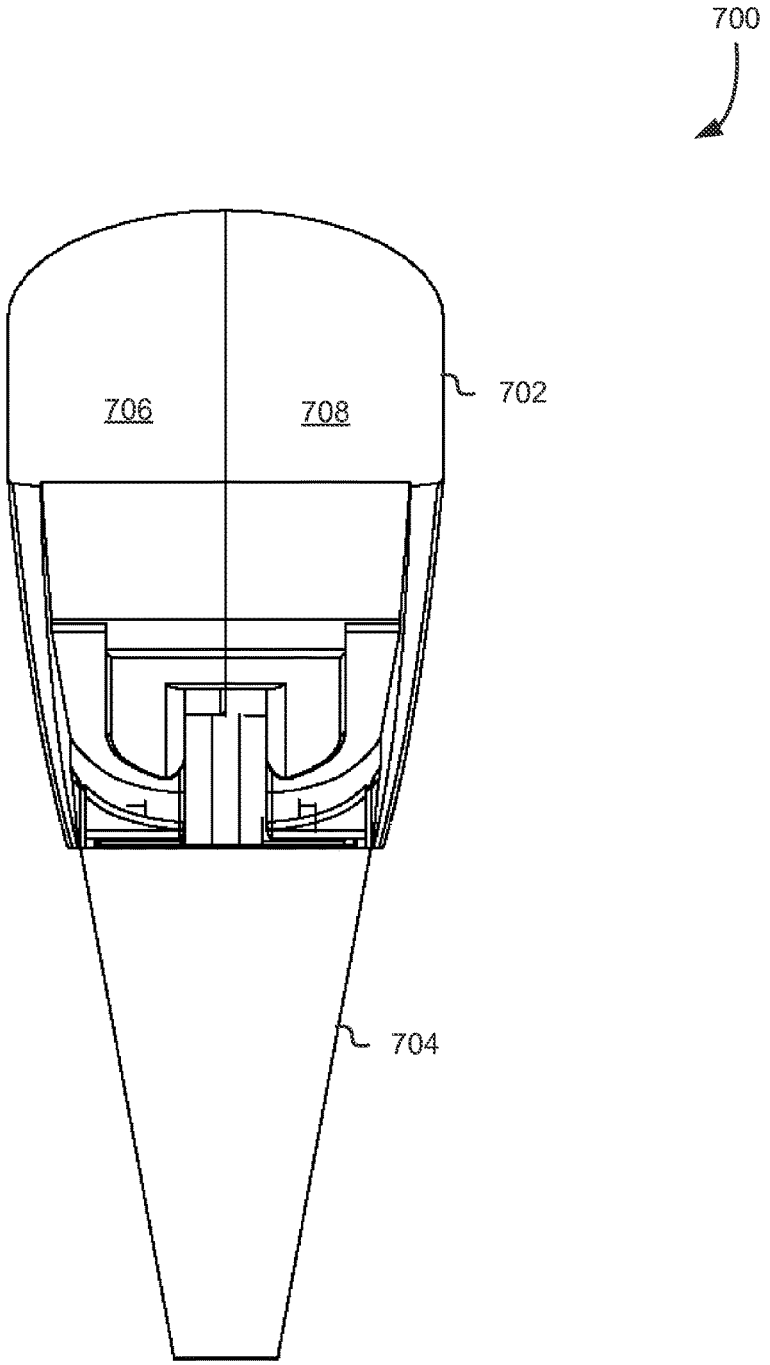
FIG. 7 illustrates a front view of a retractable heel in accordance with an embodiment.

FIG. 7 illustrates a front view 700 of a retractable heel comprising an upper heel body 702 and a lower heel body 704. FIG. 7 illustrates the retractable heel in a non-retracted position. As described herein, the upper heel body 702 may comprise one or more portions. In the example illustrated in FIG. 7, the upper heel body 702 comprises a left portion of the upper heel body 708 and a right portion of the upper heel body 706. It should be noted that, as used herein with respect to the parts of the retractable heel, the term "left" refers to the left side of the shoe and the term "right" refers to the right side of the shoe. Thus, when the view illustrated is from the front of the shoe (as in FIG. 7), the left side of the shoe is on the right side of FIG. 7 and the right side of the shoe is on the left side of FIG. 7.

In some embodiments, the left portion of the upper heel body 708 and the right portion of the upper heel body 706 may be affixed to each other using temporary or permanent mechanisms including, but not limited to, tabs, screws, nails, adhesives, or combinations of these and/or other such mechanisms. In some embodiments, the upper heel body 702 may comprise more than two portions. In such embodiments, the more than two portions of the upper heel body 702 may be affixed to one another using the temporary or permanent mechanisms described herein. The lower heel body 704 may also comprise one or more portions. As with the upper heel body, the one or more portions of the lower heel body may also be affixed to each other using the temporary or permanent mechanisms described herein. In some embodiments, the lower heel body 704 may also comprise more than two portions. In such embodiments, the more than two portions of the lower heel body 704 may also be affixed to one another using the temporary or permanent mechanisms described herein. In some embodiments, the upper heel body 702 may include a top cover that may be configured to be removed to provide access to the retractable heel mechanism within the upper heel body as described herein.

Figure 8:
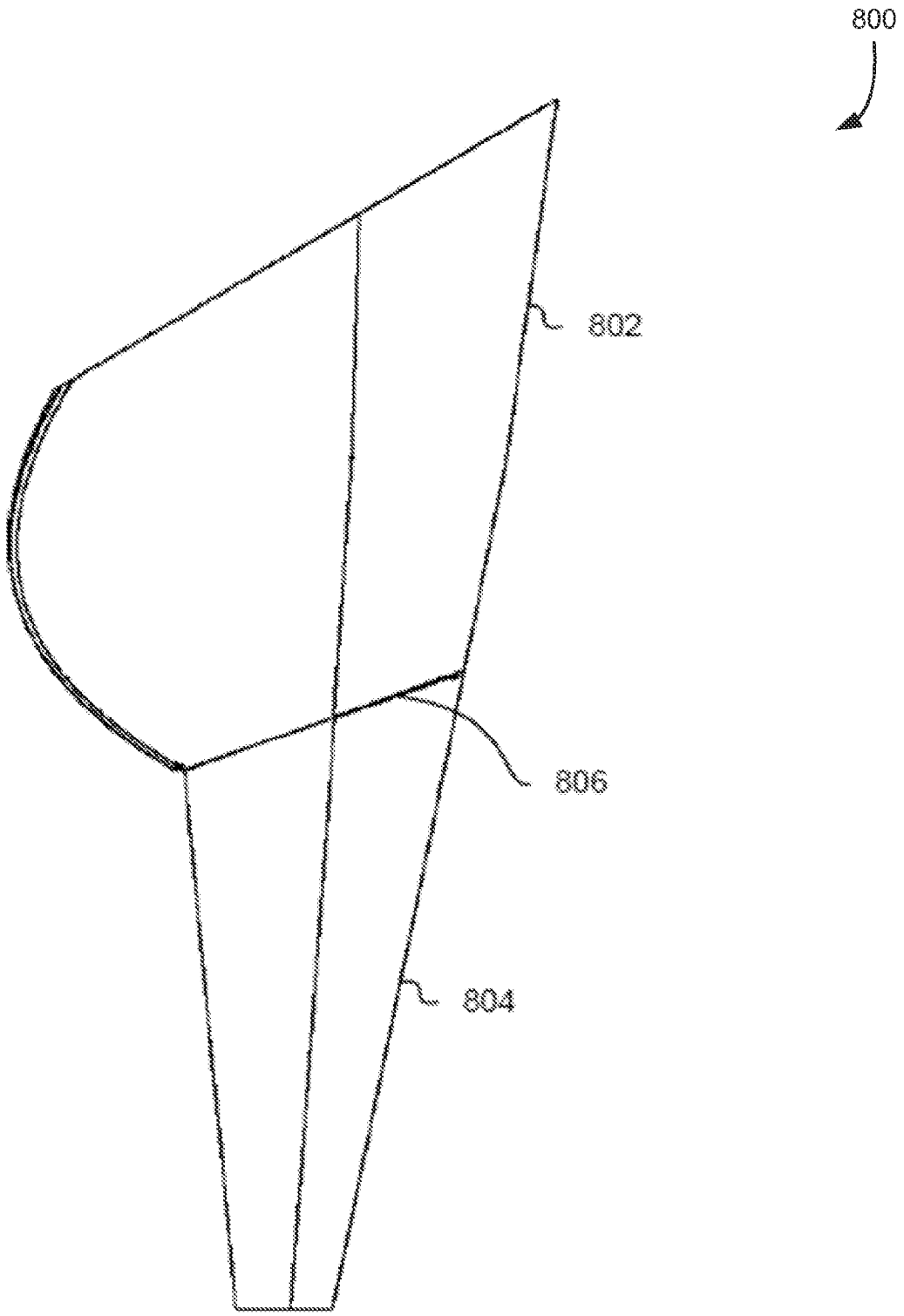
FIG. 8 illustrates a side view of a retractable heel in accordance with an embodiment.

FIG. 8 illustrates a side view 800 of the retractable heel described in connection with FIG. 7. The retractable heel illustrated in FIG. 8 comprises an upper heel body 802 with an upper heel striking surface 806 and a lower heel body 804. FIG. 8 illustrates the retractable heel in a non-retracted position.

Figure 9:
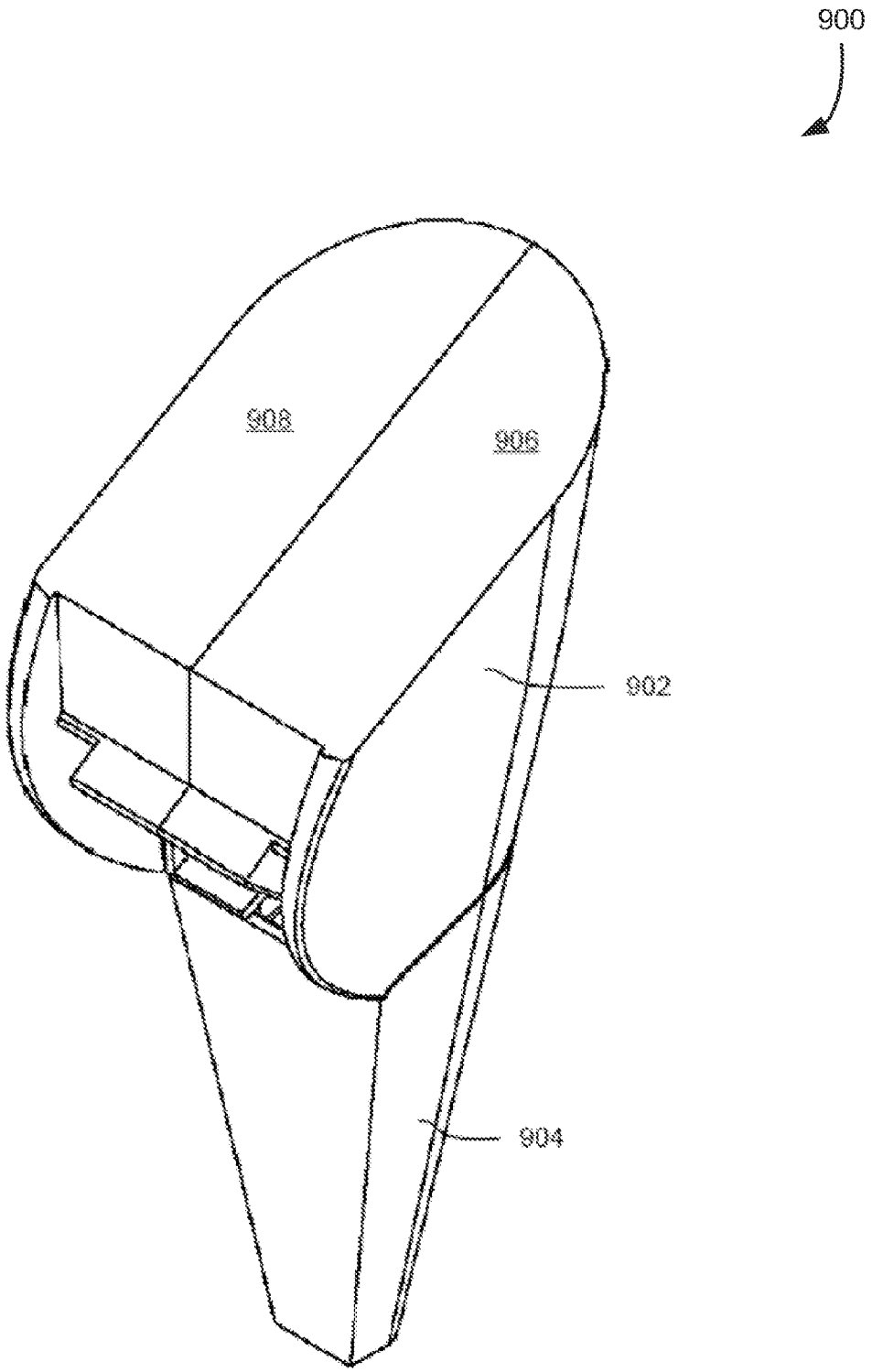
FIG. 9 illustrates a perspective view of a retractable heel in accordance with an embodiment.

FIG. 9 illustrates a perspective view 900 of the retractable heel described in connection with FIGS. 7 and 8. The retractable heel illustrated in FIG. 9 comprises an upper heel body 902 and a lower heel body 904 wherein the upper heel body 902 comprises a left portion of the upper heel body 906 and a right portion of the upper heel body 908 as described in connection with FIG. 7. FIG. 9 illustrates the retractable heel in a non-retracted position.

Figure 10:
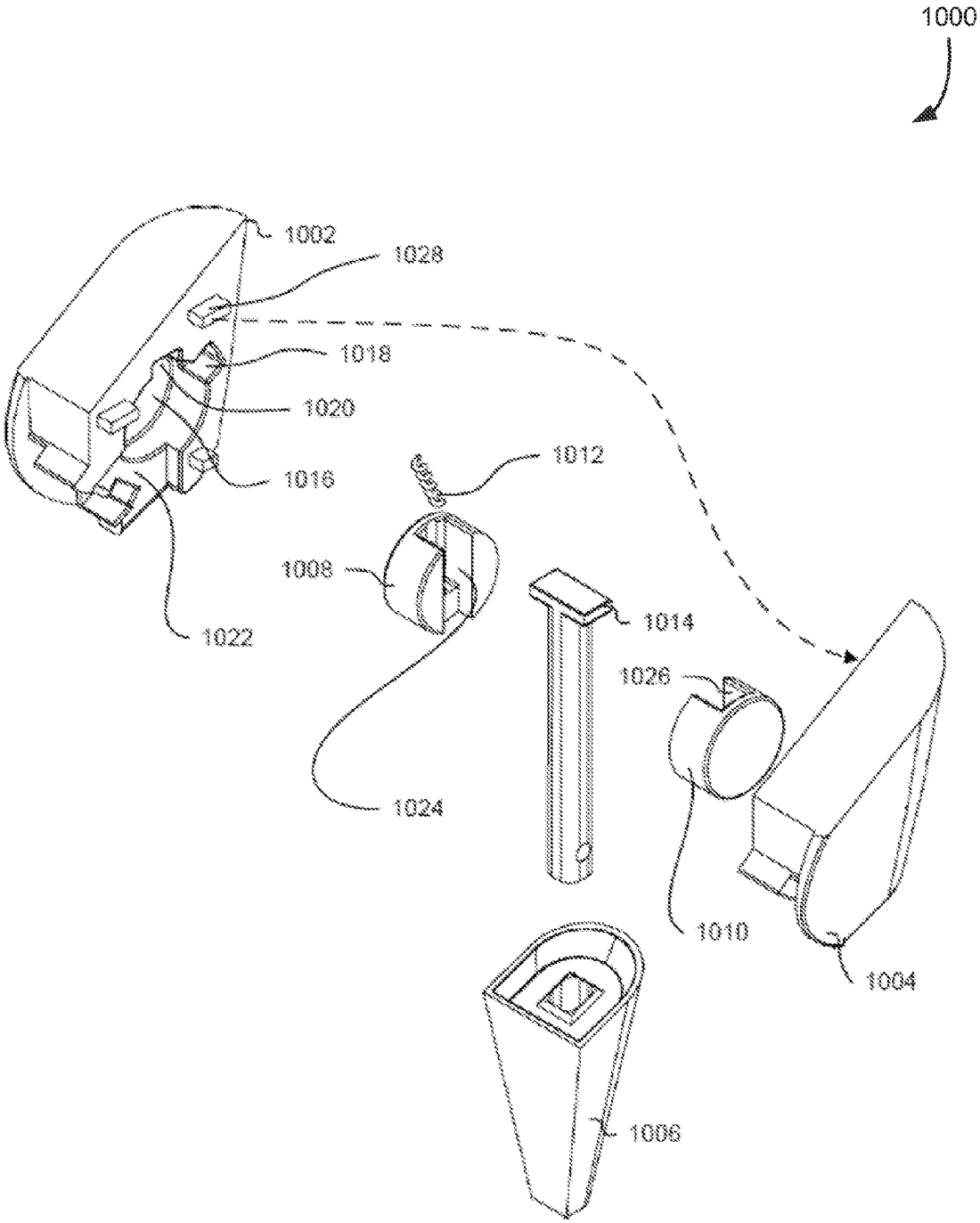
FIG. 10 illustrates an exploded view of a retractable heel in accordance with an embodiment.

FIG. 10 illustrates an exploded perspective view 1000 of the retractable heel described in connection with FIGS. 7, 8, and 9 and in accordance with an embodiment. The retractable heel illustrated in FIG. 10 comprises a left upper heel body 1004, a right upper heel body 1002, a lower heel body 1006, a circular disk (comprising a left circular disk 1010 and a right circular disk 1008 in the embodiment illustrated in FIG. 10), a connector bar 1014, and a compressible spring 1012. As described herein, the lower heel body 1006 may be placed in multiple positions by rotating the circular disk, causing the connector bar 1014 and the lower heel body 1006 to pivot to multiple positions.

The right upper heel body 1002 may include a circular indentation 1016 configured to accept the placement of the circular disk within the circular indentation 1016 and also configured to allow the rotation of the circular disk within the circular indentation 1016. In an embodiment where the upper heel body comprises a right upper heel body 1002 and a left upper heel body 1004 such as the embodiment illustrated in FIG. 10, each of the right upper heel body 1002 and the left upper heel body 1004 may include a portion of the circular indentation 1016. For example, half of the circular indentation 1016 may be within the right upper heel body 1002 and half of the circular indentation 1016 may be within the left upper heel body 1004. In an embodiment where the upper heel body comprises a right upper heel body 1002 and a left upper heel body 1004, only one of the right upper heel body 1002 and the left upper heel body 1004 may include the circular indentation. For example, the circular indentation may be in the right upper heel body 1002, and not in the left upper heel body 1004. In an embodiment where the upper heel body comprises two or more portions, one or more of the portions of the upper heel body may include a portion of the circular indentation 1016. Thus, in the example illustrated in FIG. 10, the left upper heel body 1004 may also include a circular indentation (not shown) configured to accept the placement of the circular disk within the circular indentation and also configured to allow the rotation of the circular disk within the circular indentation. It should be noted that, unless clearly stated or otherwise made clear by context, properties, components, and other aspects of the circular indentation 1016 described herein may be ascribed to the circular indentation 1016 in the right upper heel body 1002 and to the circular indentation (not shown) in the left upper heel body 1004.

The circular disk illustrated in FIG. 10 comprises a right circular disk 1008 and a left circular disk 1010. In some embodiments, the right circular disk 1008 and the left circular disk 1010 may be affixed together using a variety of techniques. For example, the right circular disk 1008 and the left circular disk 1010 may be joined using a suitable adhesive. In another example, the right circular disk 1008 and the left circular disk 1010 may include tabs and corresponding slots that, when connected, affix the right circular disk 1008 to the left circular disk 1010. In yet another example, the right circular disk 1008 and the left circular disk 1010 may be joined using one or more screws. In yet another example, the right circular disk 1008 and the left circular disk 1010 may not be affixed, and may instead be held together by affixing the right upper heel body 1002 and the left upper heel body 1004 as described herein. As may be contemplated, the methods for connecting the right circular disk and the left circular disk described herein are illustrative examples and other methods for connecting the right circular disk and the left circular disk may be considered as within the scope of the present disclosure.

As described herein, the circular indentation 1016 may be configured to allow the rotation of the circular disk by, for example, configuring the inner radius of the circular indentation to be approximately the same as, but slightly larger than, the outer radius of the circular disk. Accordingly, the circular disk may be retained within the circular indentation 1016 but may also rotate within the circular indentation.

The right circular disk 1008 may be configured with a cutout portion 1024 that is configured to accept the connector bar 1014 and that is further configured to allow the connector bar 1014 to move within the cutout portion 1024 in the right circular disk 1008. The left circular disk 1010 may also be configured with a cutout portion 1026 that is configured to accept the connector bar 1014 and that is further configured to allow the connector bar 1014 to move within the cutout portion 1026 in the left circular disk 1010. As described in connection with FIG. 4, the connector bar 1014 may pivot around a point approximately at the center of rotation of the circular disk as the circular disk rotates.

The cutout portion of the circular disk may also be configured to prevent the connector bar 1014 from moving fully through the circular disk. As illustrated in FIG. 10, the connector bar 1014 may have a first portion that is narrower in one or more dimensions and a second portion that is wider in one or more dimensions. The wider portion of the connector bar 1014 may be prevented from moving fully through the circular disk because, for example, a narrower portion of the cutout portion through the circular disk may be narrower than the wider portion of the connector bar 1014 in the one or more dimensions. FIGS. 29 to 32 illustrate connector bar embodiments with a first portion that is narrower in one or more dimensions and a second portion that is wider in one or more dimensions.

The cutout portion of the circular disk may also be configured to accept one or more compressible springs 1012 that, when in an expanded (or uncompressed) configuration, press against an upper portion of the connector bar 1014 and cause at least a portion of the upper portion of the connector bar 1014 to extend above (or beyond) the outer radius of the circular disk. When the one or more compressible springs 1012 are in a compressed configuration because, for example, the connector bar 1014 is pulled down through the circular disk, the one or more compressible springs 1012 may allow the upper portion of the connector bar 1014 to retract within the outer radius of the circular disk.

The circular indentation 1016 may also be configured with one or more retention slots placed along the inner radius (or perimeter) of the circular indentation within the right upper heel body 1002 such as the first retention slot 1018 and the second retention slot 1020. The one or more retention slots may correspond to one or more of the lower heel positions described herein (e.g., retracted, non-retracted, etc.). The one or more retention slots may be configured to accept the insertion of the upper portion of the connector bar 1014 such that, when the one or more compressible springs 1012 are in an uncompressed configuration, the upper portion of the connector bar 1014 may extend into one of the one or more retention slots. For example, the second retention slot 1020 may be configured to accept the insertion of the upper portion of the connector bar 1014 when the retractable heel is in a non-retracted position while the first retention slot 1018 may be configured to accept the insertion of the upper portion of the connector bar 1014 when the retractable heel is in a retracted position.

By extending the upper portion of the connector bar 1014 into a retention slot such as the second retention slot 1020, the circular disk may be prevented from rotating and thus, the connector bar 1014 may be prevented from pivoting, keeping the lower heel body 1006, and/or the connector bar 1014 in a non-retracted position. If the lower heel body 1006 and/or the connector bar 1014 is pulled away from the second retention slot 1020, the one or more compressible springs may be compressed, the upper portion of the connector bar 1014 may be retracted within the circular disk, the circular disk may rotate, and the lower heel body and/or the connector bar 1014 may pivot into the retracted position.

Figure 33:
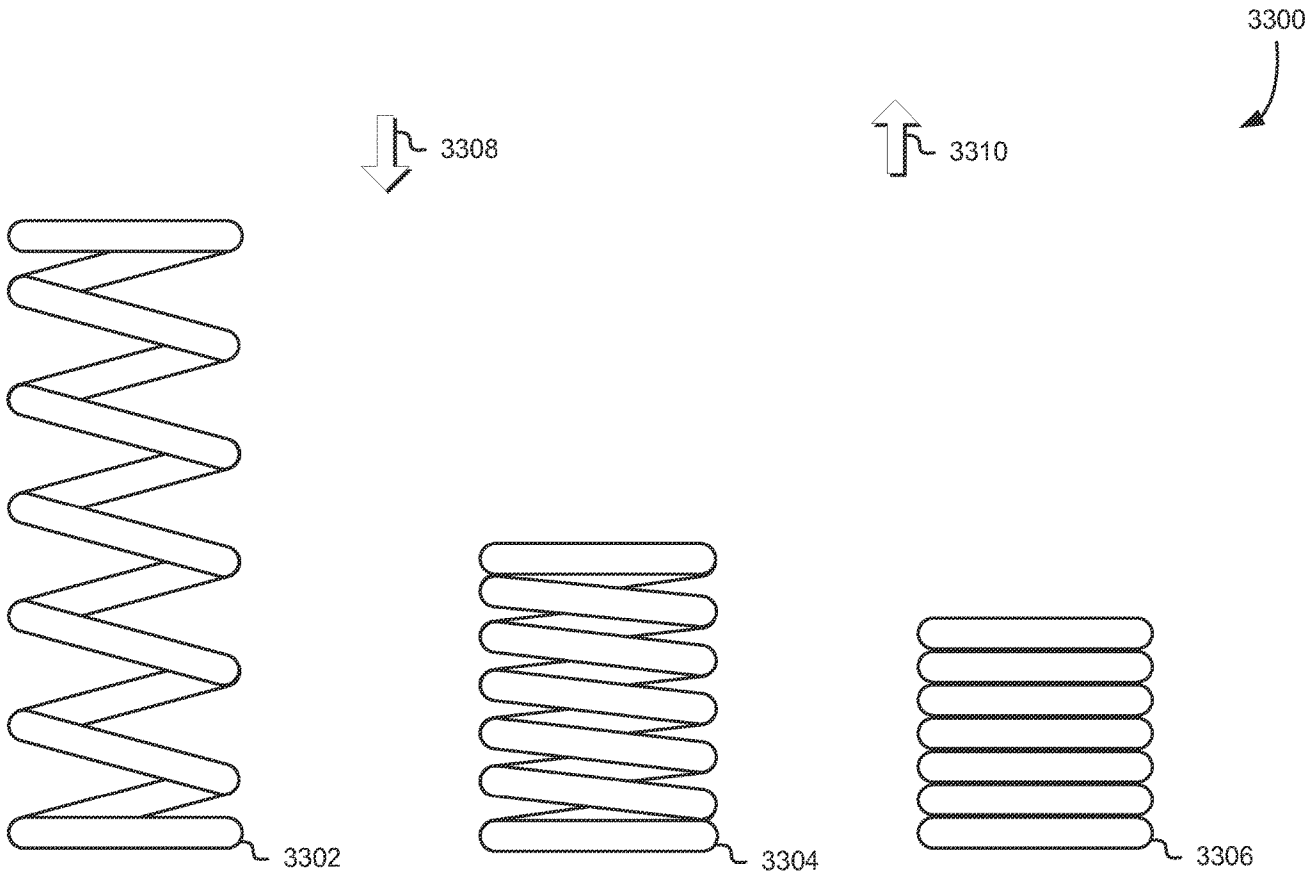
FIG. 33 illustrates a side view of a compressible spring in accordance with an embodiment.

As described herein, the right circular disk 1008 and/or the left circular disk 1010 may be configured with a cutout portion through the central portion of the circular disk (i.e., passing from one outer radius, through the center, and back out through the opposite outer radius). The cutout portion through the central portion of the circular disk may be configured to accommodate the placement of a compressible spring 1012. In an example, the compressible spring 1012 may be affixed within the circular disk using adhesive or some other such attaching mechanism. An illustrative example of a compressible spring 1012 usable for placement within the circular disk is shown in FIG. 33. It should be noted that any suitable spring may be used. For example, a spring may be located so as to require a significant downward force to be applied to the adjustable heel in order to pivot the lower heel body 1006. In another example, the spring may be an expandable spring. An expandable spring is a spring that holds the connector bar 1014 in the retention slot such as the first retention slot 1018 or the second retention slot 1020 in an at-rest position that is compressed and when the lower heel body 1006 is pulled away from the upper heel body, the spring expands, providing resistance. Such an expandable spring may be affixed to, for example, the circular disk at one end of the spring and the connector bar at the other end of the spring.

In some embodiments, the right upper heel body 1002 may include one or more tabs 1028 for attaching the right upper heel body 1002 to the left upper heel body 1004. In such embodiments, the left upper heel body 1004 may include one or more slots corresponding to the one or more tabs 1028. Both the right upper heel body 1002 and the left upper heel body 1004 may include tabs, slots, or combination of tabs and slots corresponding to the tabs, slots, or combination of tabs and slots in the opposite heel body.

In some embodiments, the lower heel body 1006 may be configured to be removed from the upper heel body by, for example, twisting the lower heel body and pulling it down to disengage the lower heel body from the upper heel body. In such embodiments, one or more lower heel bodies may be configured to be inserted into the upper heel body.

In some embodiments, the circular indentation 1016 may also be configured with a pivot slot 1022 that is configured to allow the connector bar 1014 to freely pivot when not otherwise restricted by the one or more slots. The pivot slot 1022 may also be configured to restrict the motion of the connector bar 1014 at certain limits of motion along an arc. The arc may allow motion from the starting location of the arc of the pivot slot to the ending location of the arc of the pivot slot and may restrict motion beyond those locations on the arc. The perimeter locations along the arc may be opposite from or may otherwise correspond to one or more retention slot locations as described herein. In the example illustrated in FIG. 10, the pivot slot 1022 is configured to allow the lower heel body 1006 to rotate only between the retracted position and the non-retracted position. In some embodiments, the right upper heel body 1002 and/or the left upper heel body 1004 may include tabs or any other suitable protrusions for securing the lower heel body 1006 in the non-retracted position. In such embodiments, the lower heel body may include slots corresponding to the tabs or other suitable protrusions.

In some embodiments, the right upper heel body 1002 and the left upper heel body 1004 may be mirror images of each other. As described herein, a circular indentation 1016 may be formed within each of the right upper heel body 1002 and the left upper heel body 1004. The circular indentation 1016 may, in some embodiments, accommodate a circular disk in the right upper heel body 1002 and in the left upper heel body 1004. Multiple retention slots connected to the circular indentation may be formed within each of the right upper heel body 1002 and the left upper heel body 1004. As described herein, the multiple protrusions may be used to constrain the possible positions of the retractable heel. In addition, a pivot slot 1022 may be formed within each of the right upper heel body 1002 and the left upper heel body 1004 that is connected to the circular indentation 1016 and on an opposing end of the one or more retention slots. This may, for example, accommodate the movement of the retractable heel described herein between multiple positions for creating a high heel (e.g., the non-retracted position) and a low heel (e.g., the refracted position).

It should further be noted that the right upper heel body 1002 and the left upper heel body 1004, together with the lower heel body 1006 may be formed to accommodate different designs and/or styles. For example, the upper heel body and the lower heel body may be customized to be incorporated with a designer's specifications such as, for example, conforming to a particular width, conforming to a particular height, conforming to a particular angle, and other such design considerations.

A connector bar 1014 may be used to connect the upper heel body (i.e., the right upper heel body 1002 and the left upper heel body 1004) and lower heel body 1006. In an embodiment where the connector bar 1014 is a T-shaped bar or some other shape (as described in connection with FIGS. 29 to 32), protrusions of the connector bar 1014 may be positioned at the end of one or more compressible springs such as the compressible spring 1012. As described herein, indentations, slots, and other cutout portions and/or cutout sub-portions may be provided to accommodate the movement of the connector bar 1014 and the circular disk between multiple positions including, but not limited to, a non-retracted position (also referred to herein as a "high heel position" or a retracted position (also referred to herein as a "low heel position"). The connector bar 1014 may be positioned so that it extends into a slot formed within lower heel body 1006 as described herein.

In some embodiments, a first portion of the connector bar 1014 may be located within upper heel body and a second portion of the connector bar 1014 may be located within the lower heel body 1006. In such embodiments, the compressible spring 1012 may provide force to keep the lower heel body 1006 pressed against the upper heel body. In response to the wearer of the shoe pulling down on the lower heel body 1006 and pivoting it forward, the lower heel body 1006 may pivot between multiple positions. For example, in response to the wearer of the shoe pulling on the lower heel body (e.g., down when in high heel position and toward the toe of the shoe when in low heel position), the compressible spring 1012 may be compressed to allow the wearer to pivot the lower heel body 1006 forward (i.e., toward the toe of the shoe) to the retracted position or backward (i.e. toward the heel of the shoe) to the non-retracted position. Upon selecting a position based on the retention slots such as the first retention slot 1018 or the second retention slot 1020 within the upper heel body, the lower heel body may be locked or secured such that the application of some requisite force may needed in order to re-trigger the mechanism for moving between the multiple positions. This may, for example, inhibit the lower heel body 1006, the circular disk (i.e., the right circular disk 1008 and the left circular disk 1010), and/or the connector bar 1014 from movement while wearing the shoe.

In some embodiments, the right upper heel body 1002 and/or the left upper heel body 1004 may include concave portions or any other suitable concavity to match the top portion of the lower heel body 1006. For example, matching the bottom section of the upper heel body to a concavity of the heel may cover the portion of the upper heel body that touches the ground. In another example, there may be a concave portion so that, when the heel is retracted, it may be pointed down and locked in a back square extrusion and may also be resting on the extrusion.

In some embodiments, the bottom portion of the upper heel body may be formed to fit within a recessed portion of the lower heel body 1006 to, for example, provide an additional mechanism to secure the lower heel body 1006 to the upper heel body. More specifically, such a recessed portion may inhibit the lower heel body 1006 from rotating or sliding relative to the upper heel body.

It should also be noted that any suitable material can be used to form the elements of the retractable heel. For example, the connector bar 1014 and/or the circular disk may be formed of stainless steel, steel, titanium, or some other such metal to provide strength and durability, while the upper heel body and/or the lower heel body may be formed from a suitable polymeric material, from wood, from metal, or from a combination of these and/or other such materials. In another example, each element of the adjustable heel may be formed using a polymeric material, such as acrylonitrile butadiene styrene ("ABS") or polylactic acid ("PLA"). In some embodiments, such elements may be produced using, for example, a three-dimensional printer. In an embodiment, designer logos and/or other such design elements may be included in the heel body elements when the heel body elements are manufactured.

In some embodiments, the retractable heel described herein may be attached beneath the heel portion of any suitable shoe or shoe frame. For example, the retractable heel may be attached to an existing shoe. In another example, the retractable high heel may be incorporated into a newly manufactured shoe. In some embodiments, the shoe may be flexible such as, for example, with a toe section of the base of the shoe that is flexible with fabric or other such top portions of the shoe that may also be flexible. In some embodiments, a platform may be attached beneath the toe portion of the shoe. For example, a platform that is half an inch in height may be attached substantially beneath the toe portion of the shoe for the wearer's comfort with a corresponding increase in the height of the upper shoe body and/or the lower shoe body.

Figure 11:
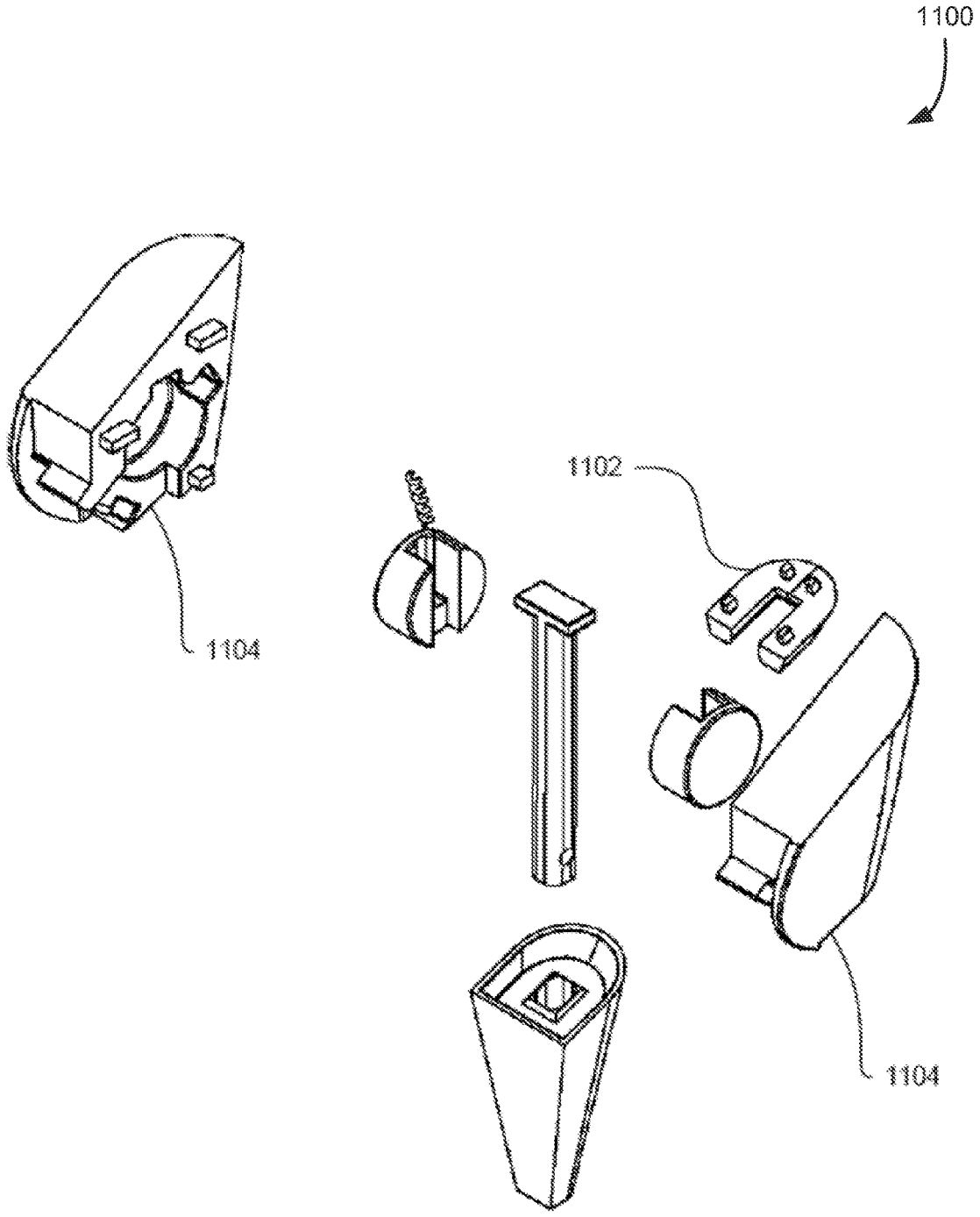
FIG. 11 illustrates an exploded view of a retractable heel in accordance with an embodiment.

FIG. 11 illustrates an exploded perspective view 1100 of the retractable heel described in connection with FIG. 10 and in accordance with an embodiment. In some embodiments, the lower heel body such as the lower heel body 1006 described in FIG. 10 may be attached to the base of the upper heel body. For example, the top portion of the upper heel body and the bottom portion of the upper heel body may be substantially parallel to each other such that the bottom upper heel body may be configured as the base of a low heel (i.e., when the lower heel body is in the retracted position). In such an example, the upper heel striking surface 1104 may be fitted with an upper heel striking surface pad 1102 that may be configured to protect the lower portion of the upper heel body while still allowing the lower heel body and the connector bar to pivot between a retracted position and a non-retracted position. The upper heel striking surface pad 1102 may be made of rubber, or plastic, or metal, or ceramic, or some other such material that may be suitable for protecting the lower portion of the upper heel body. The upper heel striking surface pad may also be configured to, for example, provide additional traction for the wearer of the shoe when the retractable heel is in a retracted position.

Figure 12:
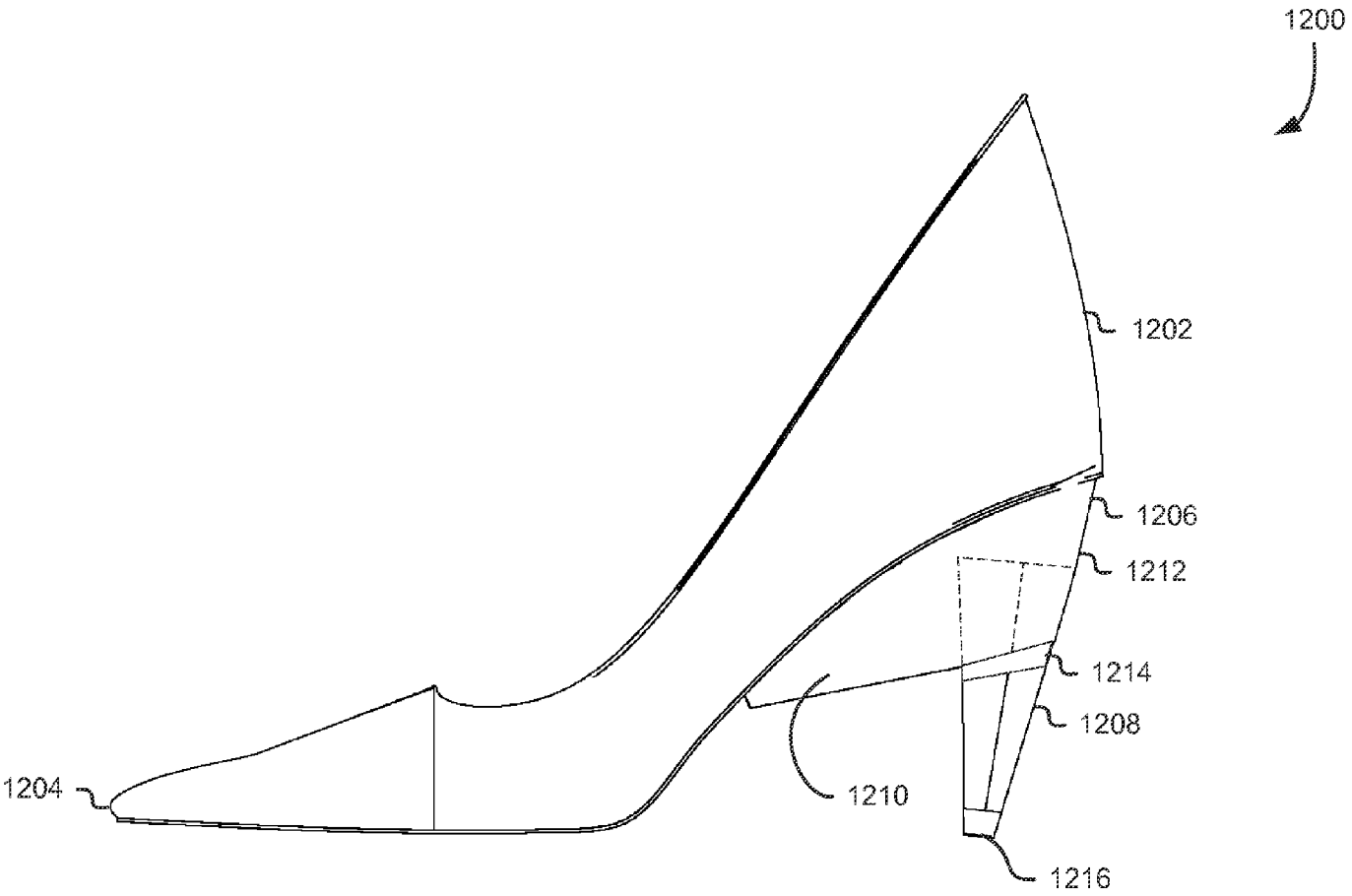
FIG. 12 illustrates a side view of a shoe with a retractable heel in accordance with an embodiment.

FIG. 12 illustrates a side view 1200 of a shoe with a retractable heel as described in connection with FIG. 10 and in accordance with an embodiment. FIG. 12 illustrates a shoe with the retractable heel in a non-retracted position. The shoe illustrated in FIG. 1 comprises a heel portion 1202 and a toe portion 1204 with a retractable heel 1206 attached to the shoe at the heel portion 1202. The retractable heel 1206 illustrated in FIG. 12 comprises an upper heel body 1212 and a lower heel body 1208, with the lower heel body attached to the upper heel body using a mechanism such as one of the one or more mechanisms described herein. The upper heel body 1212 further comprises an upper heel body extension 1210, configured to at least partially obscure the lower heel body 1208 when it is in a retracted position. The upper heel body 1212 includes an upper heel striking surface 1214 as described herein. The lower heel body 1208 includes a lower heel striking surface 1216 at the lower portion of the lower heel body 1208 that is configured to contact the ground when the lower heel body 1208 is in a non-retracted position and that is prevented from contacting the ground when the lower heel body 1208 is in a retracted position due to the lower heel body 1208 being retracted. The lower heel striking surface 1216 may also be configured to provide additional fraction and/or stability for the wearer when the lower heel body 1208 is in a non-retracted position and may include, for example, a lower heel striking surface pad as described herein.

Figure 13:
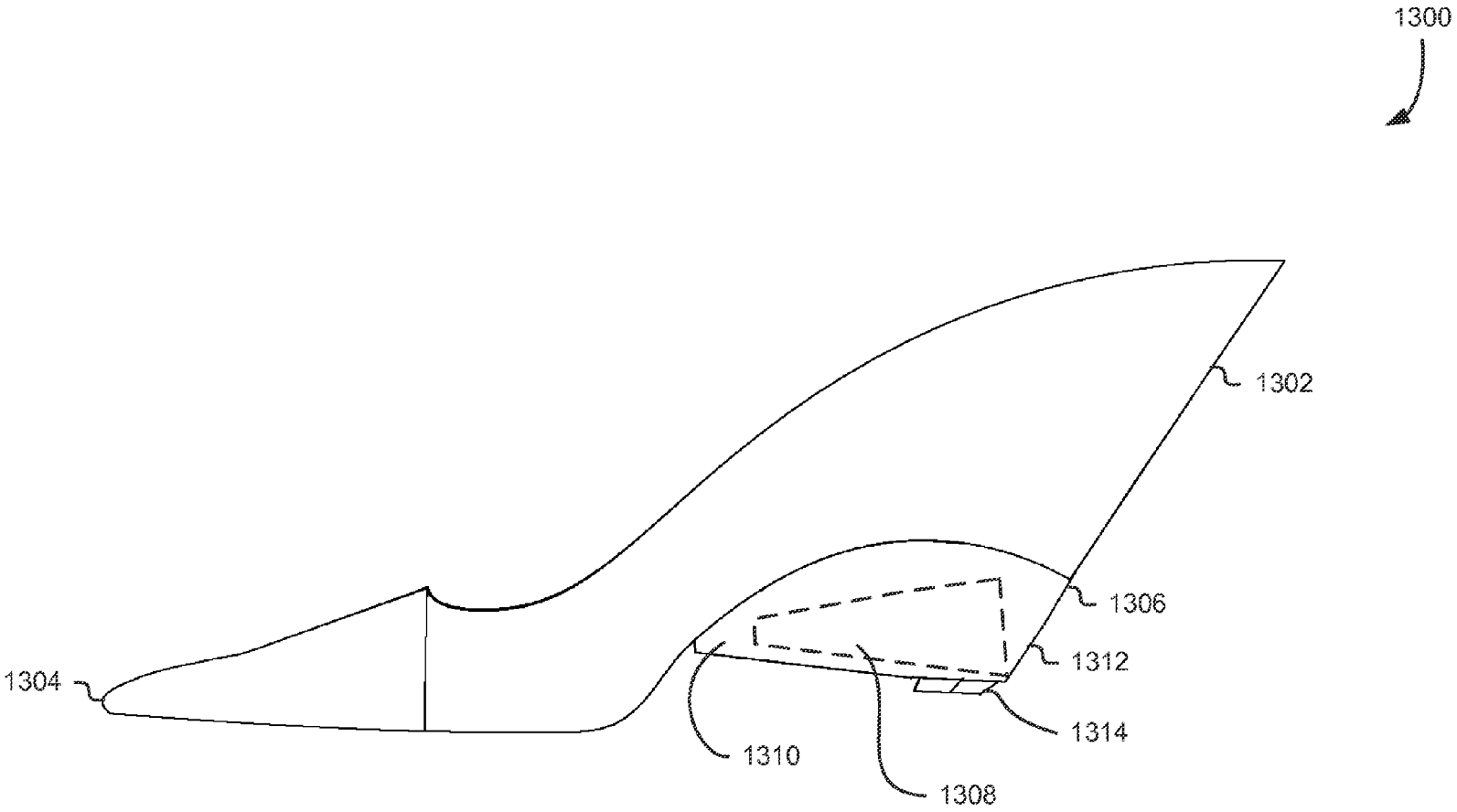
FIG. 13 illustrates side view of a shoe with a retractable heel in a retracted position in accordance with an embodiment.

FIG. 13 illustrates a side view 1300 of a shoe with a retractable heel as described in connection with FIG. 12 and in accordance with an embodiment. FIG. 13 illustrates a shoe with the retractable heel in a retracted position. The shoe illustrated in FIG. 13 comprises a heel portion 1302 and a toe portion 1304 with a retractable heel 1306 attached to the shoe at the heel portion 1302. The retractable heel 1306 illustrated in FIG. 13 comprises an upper heel body 1312 and a lower heel body 1308, with the lower heel body 1308 attached to the upper heel body 1312 using a mechanism such as one of the one or more mechanisms described herein. The upper heel body 1312 further comprises an upper heel body extension 1310, configured to at least partially obscure the lower heel body 1308 when it is in a retracted position as illustrated in FIG. 13. The retractable heel 1306 illustrated in FIG. 13 includes an upper heel striking surface 1314 at the lower portion of the upper heel body 1312 as described herein.

FIGS. 14 to 17 illustrate a retractable heel for use with a shoe with a retractable heel as described in connection with FIG. 12 and in accordance with an embodiment.

Figure 14:
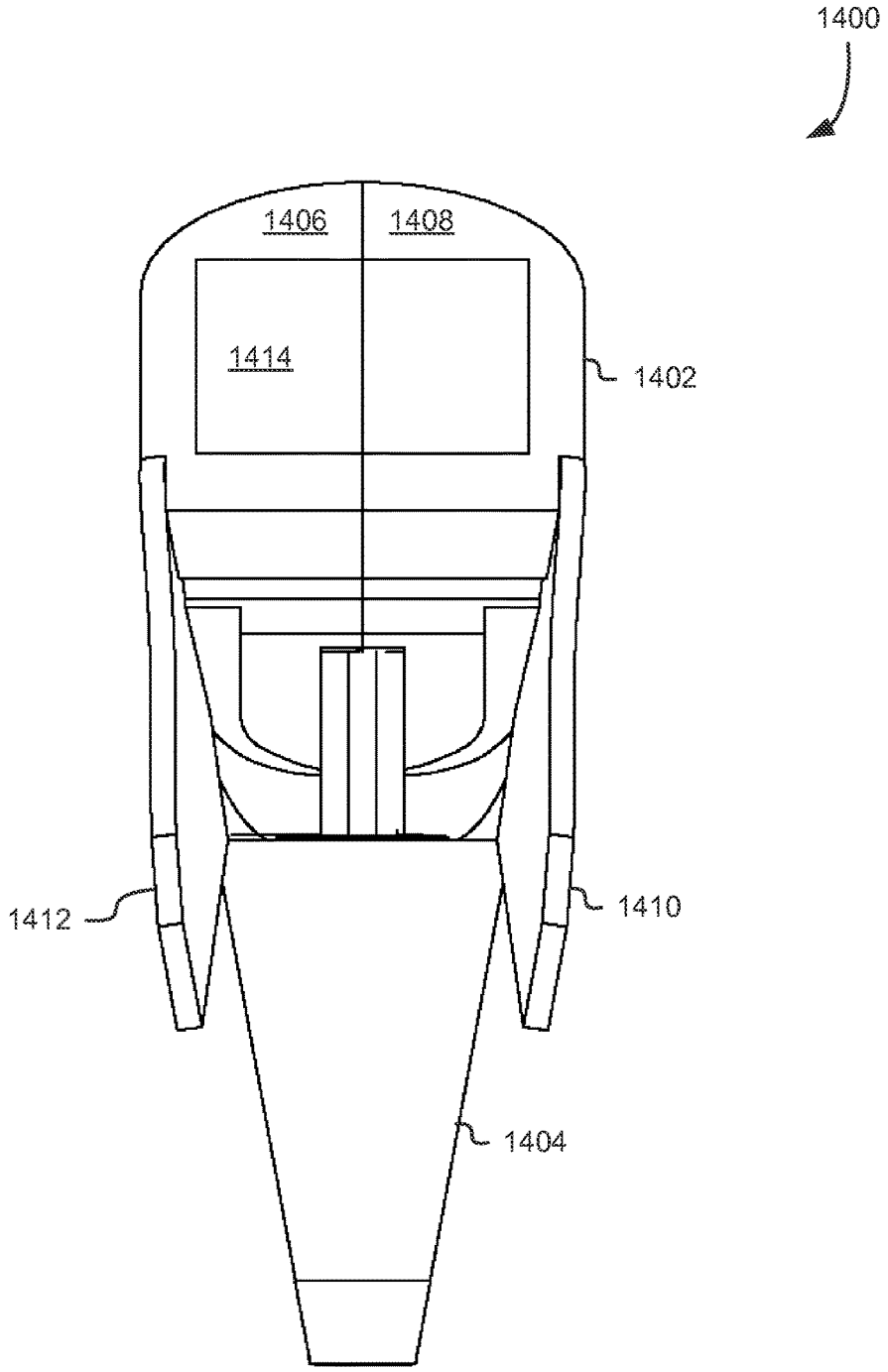
FIG. 14 illustrates a front view of a retractable heel in accordance with an embodiment.

FIG. 14 illustrates a front view 1400 of a retractable heel for use with a shoe with a retractable heel as described in connection with FIG. 12 and in accordance with an embodiment. The retractable heel illustrated in FIG. 14 comprises an upper heel body 1402 and a lower heel body 1404. FIG. 14 illustrates the retractable heel in a non-retracted position. As described herein, the upper heel body 1402 may comprise one or more portions. In the example illustrated in FIG. 14, the upper heel body 1402 comprises a right portion of the upper heel body (also referred to herein as the right upper heel body 1406) and a left portion of the upper heel body (also referred to herein as the left upper heel body 1408), which may be affixed to each other as described herein. The upper heel body 1402 may also include a top cover 1414 which may be configured to be removed to provide access to the retractable heel mechanism within the upper heel body. The right upper heel body 1406 may include right upper heel body extension 1412, configured to, for example, partially obscure the lower heel body 1404 when the lower heel body 1404 is in a retracted position. Similarly, the left upper heel body 1408 may include left upper heel body extension 1410, configured to, for example, partially obscure the lower heel body 1404 when the lower heel body 1404 is in a retracted position. The right upper heel body extension 1412 and/or the left upper heel body extension 1410 may also be configured to provide other functionality including, but not limited to, aiding in the attachment of the retractable heel to the shoe or aiding in the structural integrity of the retractable heel. Additionally, the right upper heel body extension 1412 and/or the left upper heel body extension 1410 may be configured according to the design of the shoe.

Figure 15:
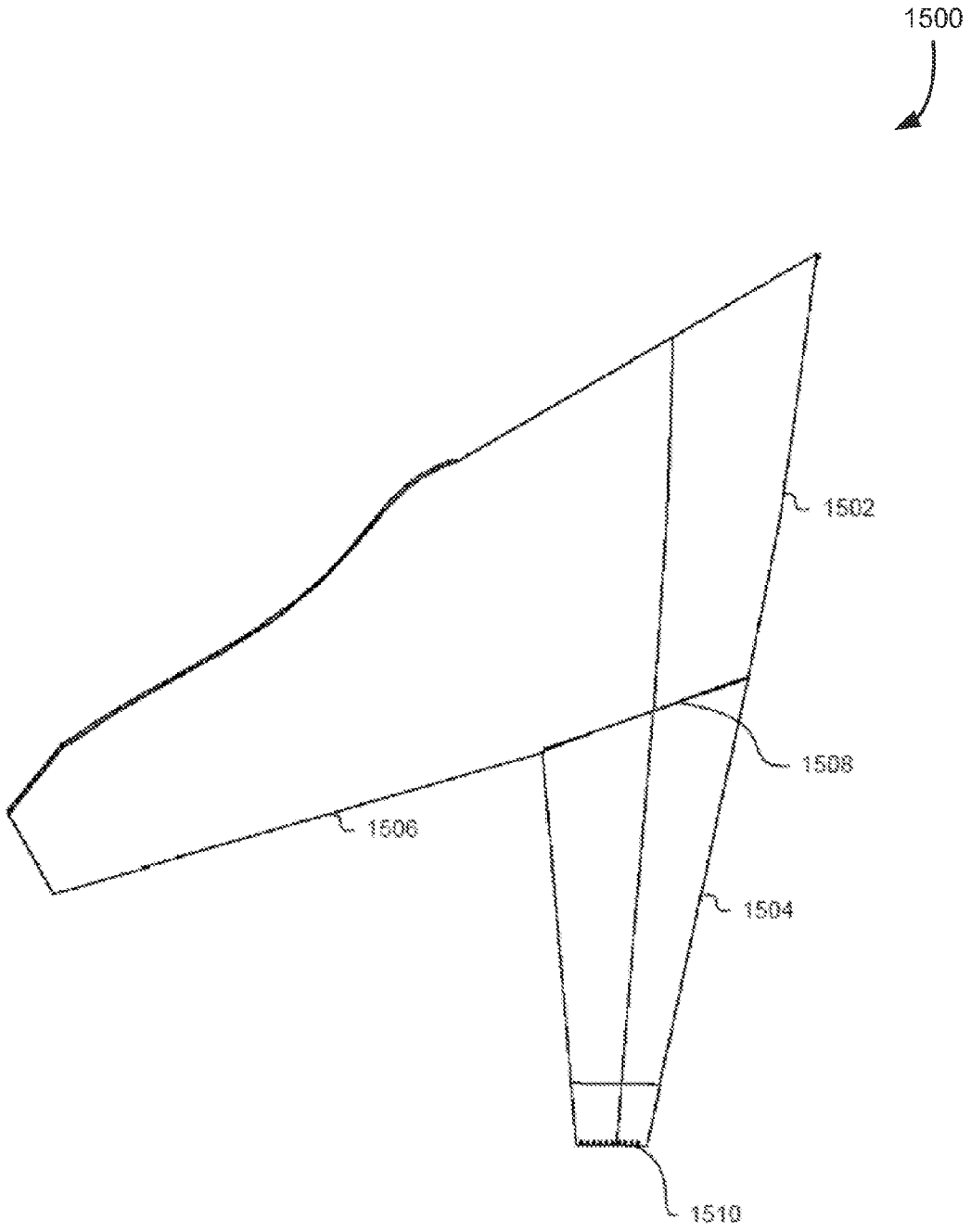
FIG. 15 illustrates a side view of a retractable heel in accordance with an embodiment.

FIG. 15 illustrates a side view 1500 of the retractable heel described in connection with FIG. 14. The retractable heel illustrated in FIG. 15 comprises an upper heel body 1502 with an upper heel body extension 1506 and a lower heel body 1504. The upper heel body 1502 includes an upper heel striking surface 1508. The lower heel body 1504 includes a lower heel striking surface 1510. FIG. 15 illustrates the retractable heel in a non-retracted position.

Figure 16:
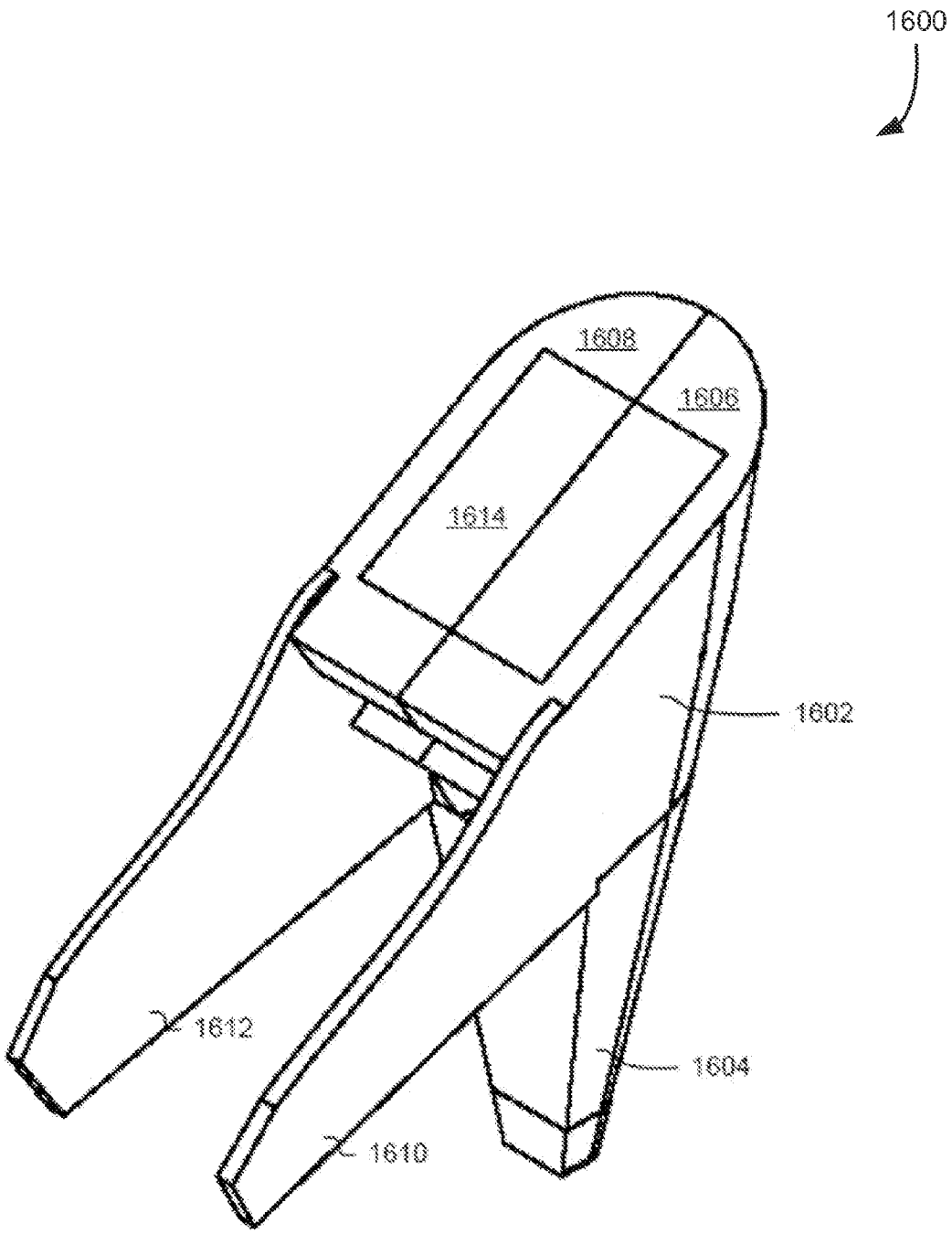
FIG. 16 illustrates a perspective view of a retractable heel in accordance with an embodiment.

FIG. 16 illustrates a perspective view 1600 of the retractable heel described in connection with FIGS. 14 and 15. The retractable heel illustrated in FIG. 16 comprises an upper heel body 1602 and a lower heel body 1604 wherein the upper heel body 1602 comprises a left portion of the upper heel body 1606 and a right portion of the upper heel body 1608 as described in connection with FIG. 14. The left portion of the upper heel body 1606 further comprises a left upper heel body extension 1610 and the right portion of the upper heel body 1608 further comprises a right upper heel body extension 1612 as described herein. The upper heel body 1602 may also include a top cover 1614 as described herein. FIG. 16 illustrates the retractable heel in a non-retracted position.

Figure 17:
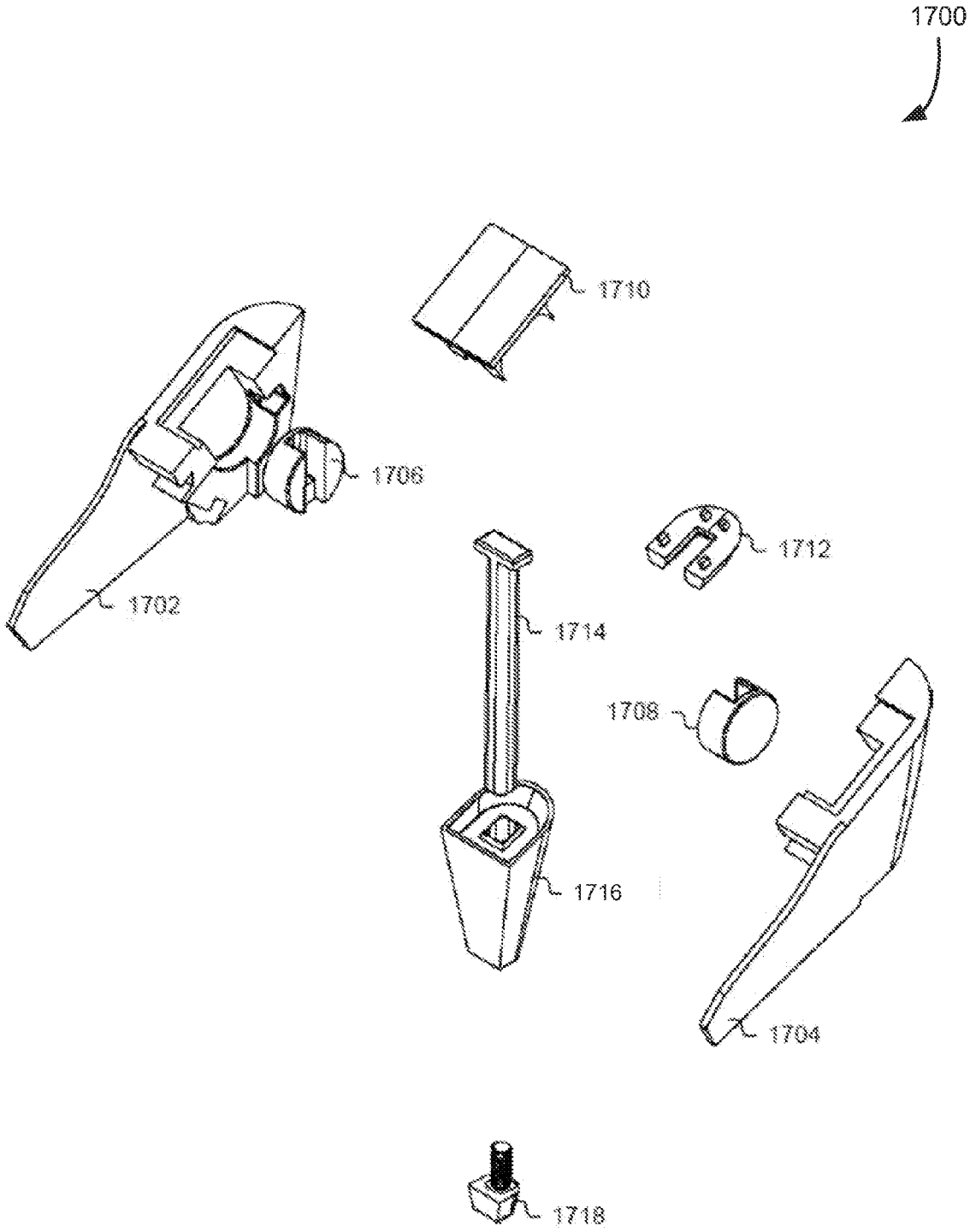
FIG. 17 illustrates an exploded view of a retractable heel in accordance with an embodiment.

FIG. 17 illustrates an exploded perspective view 1700 of the retractable heel described in connection with FIGS. 14, 15, and 16 and in accordance with an embodiment. The retractable heel illustrated in FIG. 17 comprises a left upper heel body 1704 with a left upper heel body extension, a right upper heel body 1702 with a right upper heel body extension, a lower heel body 1716, a circular disk (comprising a left circular disk 1708 and a right circular disk 1706), a connector bar 1714, an upper heel striking surface pad 1712, a lower heel striking surface pad 1718, and a top cover 1710. As described herein, the lower heel body 1716 may be placed in multiple positions by rotating the circular disk, causing the connector bar 1714 and the lower heel body 1716 to pivot to multiple positions.

The left upper heel body 1704 may be substantially the same as the left upper heel body 1004 described in connection with FIG. 10, but with the addition of the left upper heel body extension. The right upper heel body 1702 may be substantially the same as the right upper heel body 1002 described in connection with FIG. 10, but with the addition of the right upper heel body extension. The left circular disk 1708 may be substantially the same as the left circular disk 1010 described in connection with FIG. 10. The right circular disk 1706 may be substantially the same as the right circular disk 1008 described in connection with FIG. 10. The lower heel body 1716 may be substantially the same as the lower heel body 1006 described in connection with FIG. 10. The connector bar 1714 may be substantially the same as the connector bar 1014 described in connection with FIG. 10. The upper heel striking surface pad 1712 may be substantially the same as the upper heel striking surface pad 1102 described in connection with FIG. 11.

The top cover 1710 illustrated in FIG. 17 may be attached to one or more of the right upper heel body 1702 and the left upper heel body 1704. In some embodiments, the top cover 1710 may be removable so that the right circular disk 1706, the left circular disk 1708, the connector bar 1714, or other such parts of the retractable heel may be accessed. The top cover 1710 may be temporarily or permanently attached to the upper heel body using temporary or permanent mechanisms such as those described herein. The lower heel striking surface pad 1718 illustrated in FIG. 17 may attach to the lower heel body 1716 and/or may attach to the connector bar 1714. The lower heel striking surface pad 1718 may include a connector portion configured for attaching the lower heel striking surface pad 1718 to the connector bar 1714 and a pad portion configured to strike the terrain surface. For example, the lower heel striking surface pad 1718 may include a threaded connector portion that may be attached to a corresponding threaded portion (also referred to herein as a "threaded end") of the connector bar 1714. In another example, the lower heel striking surface pad 1718 may be glued or otherwise permanently affixed to the lower heel body 1716.

Figure 18:
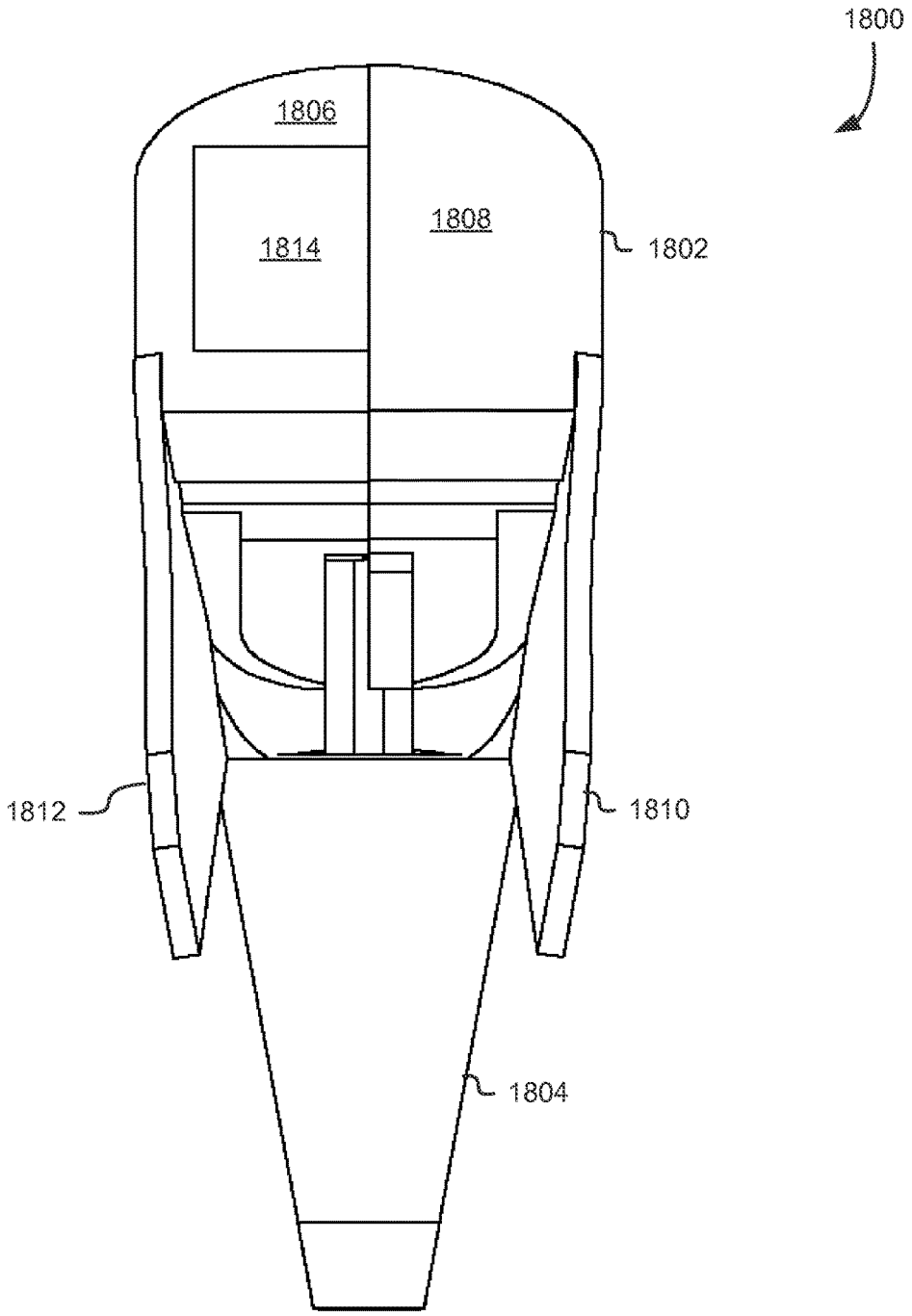
FIG. 18 illustrates a front view of a retractable heel in accordance with an embodiment.
Figure 19:
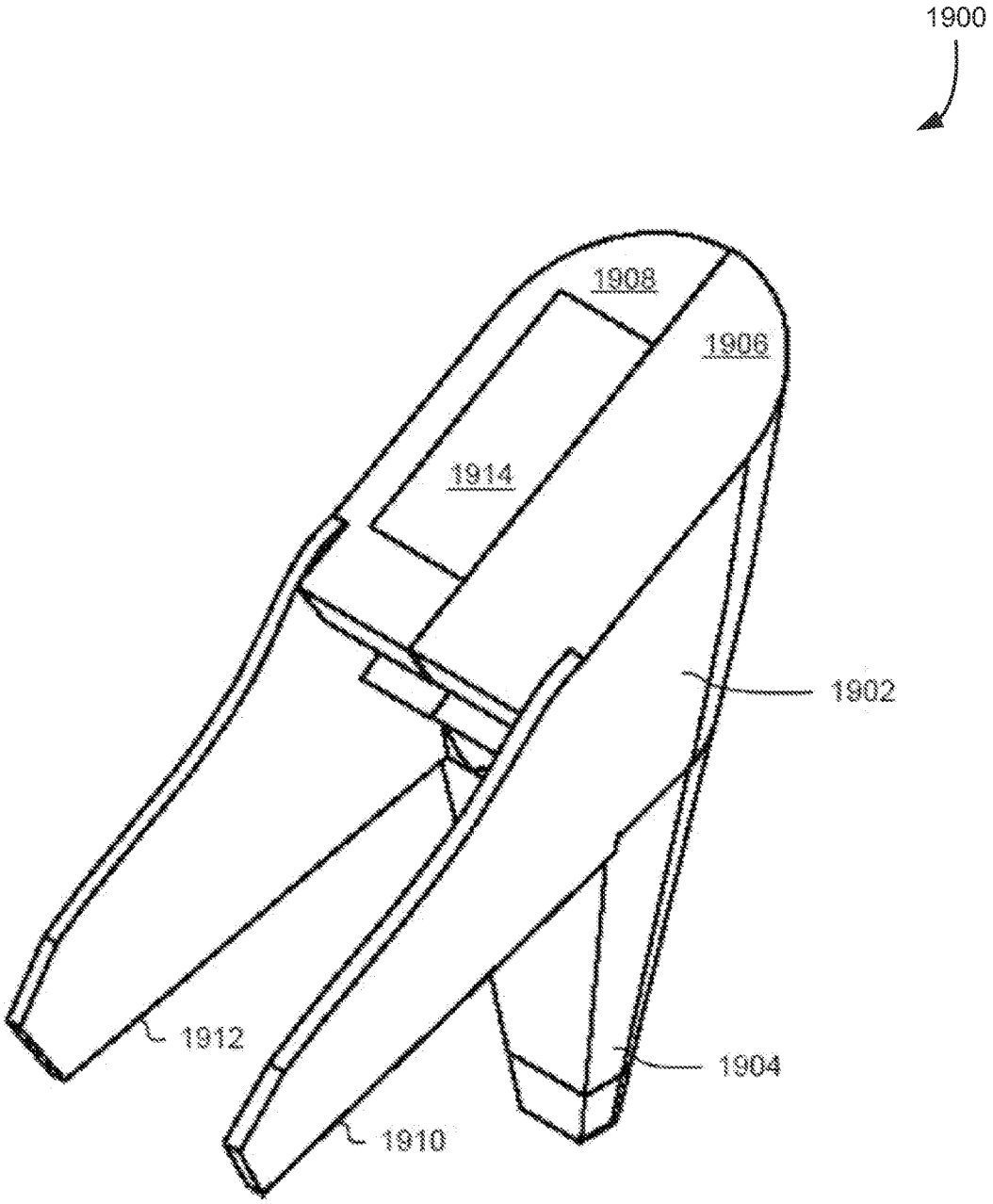
FIG. 19 illustrates a perspective view of a retractable heel in accordance with an embodiment.
Figure 20:
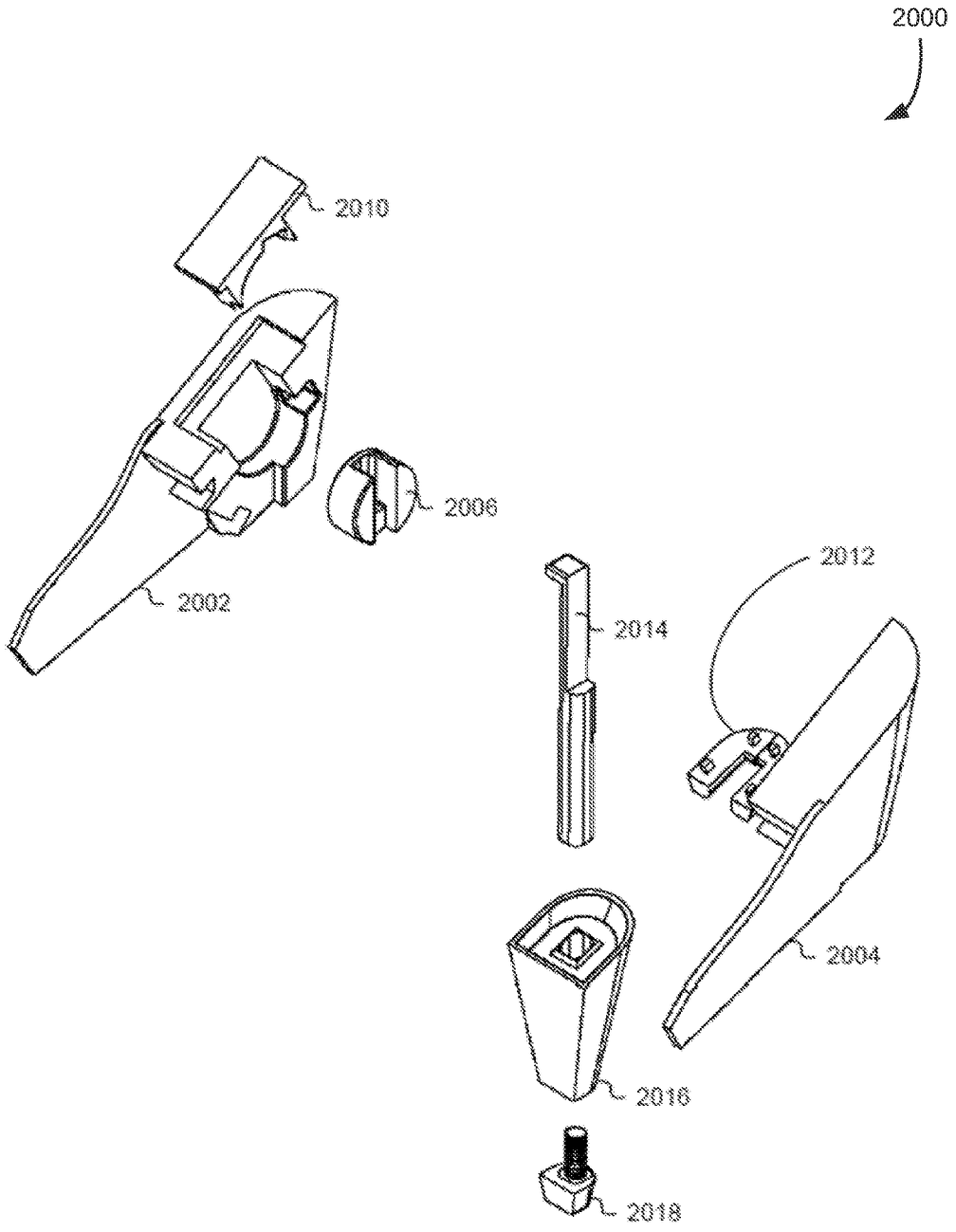
FIG. 20 illustrates an exploded view of a retractable heel in accordance with an embodiment.

FIGS. 18 to 20 illustrate a retractable heel for use with a shoe with a retractable heel as described in connection with FIG. 12 and in accordance with an embodiment. FIGS. 18 to 20 illustrate an embodiment where the retractable heel mechanism described herein is included in only one half of the upper heel body (in the example illustrated, in the right half of the upper heel body). FIGS. 18 to 20 illustrate an embodiment with upper heel body extensions but, as may be contemplated, the embodiment illustrated in FIGS. 18 to 20 may be configured without the upper heel body extensions.

FIG. 18 illustrates a front view 1800 of a retractable heel for use with a shoe with a retractable heel as described in connection with FIG. 12 and in accordance with an embodiment. The retractable heel illustrated in FIG. 18 comprises an upper heel body 1802 and a lower heel body 1804. FIG. 18 illustrates the retractable heel in a non-retracted position. In the example illustrated in FIG. 18, the upper heel body 1802 comprises a right upper heel body 1806 and a left upper heel body 1808, which may be affixed to each other as described herein. The right upper heel body 1806 may also include a top cover 1814 such as top cover 1414 described in connection with FIG. 14. The right upper heel body 1806 may include right upper heel body extension 1812 such as the right upper heel body extension 1412 described in connection with FIG. 14. Similarly, the left upper heel body 1808 may include left upper heel body extension 1810 such as the left upper heel body extension 1410 described in connection with FIG. 14.

FIG. 19 illustrates a perspective view 1900 of the retractable heel as described in connection with FIG. 18 and in accordance with an embodiment. The retractable heel illustrated in FIG. 19 comprises an upper heel body 1902 and a lower heel body 1904 wherein the upper heel body 1902 comprises a left portion of the upper heel body 1906 and a right portion of the upper heel body 1908. The left portion of the upper heel body 1906 further comprises a left upper heel body extension 1910 and the right portion of the upper heel body 1908 further comprises a right upper heel body extension 1912 as described herein. The right portion of the upper heel body 1908 may also include a top cover 1914 as described herein. FIG. 19 illustrates the retractable heel in a non-retracted position.

FIG. 20 illustrates an exploded perspective view 2000 of the retractable heel described in connection with FIGS. 18 and 19 and in accordance with an embodiment. The retractable heel illustrated in FIG. 20 comprises a left upper heel body 2004 with a left upper heel body extension, a right upper heel body 2002 with a right upper heel body extension, a lower heel body 2016, a circular disk 2006, a connector bar 2014, an upper heel striking surface pad 2012, a lower heel striking surface pad 2018, and a top cover 2010. As described herein, the lower heel body 2016 may be placed in multiple positions by rotating the circular disk 2006, causing the connector bar 2014 and the lower heel body 2016 to pivot to multiple positions.

The left upper heel body 2004 may be substantially the same as the left upper heel body 1704 described in connection with FIG. 17. The right upper heel body 2002 may be substantially the same as the right upper heel body 1702 described in connection with FIG. 17. The lower heel body 2016 may be substantially the same as the lower heel body 1716 described in connection with FIG. 17. The upper heel striking surface pad 2012 may be substantially the same as the upper heel striking surface pad 1712 described in connection with FIG. 17. The lower heel striking surface pad 2018 may be substantially the same as the lower heel striking surface pad 1718 described in connection with FIG. 17. The top cover 2010 illustrated in FIG. 20 may be attached to the right upper heel body 2002 and may be removable so that the circular disk 2006, the connector bar 2014, or other such parts of the retractable heel may be accessed. The top cover 2010 may be temporarily or permanently attached to the right upper heel body 2002 using temporary or permanent mechanisms such as those described herein.

The circular disk 2006 may be substantially the same as the right circular disk 1706 described in connection with FIG. 17 or may have a different configuration based on, for example, the shape of the connector bar 2014. For example, the connector bar 2014 may be an "L-shaped" connector bar (i.e., with a single protrusion as illustrated in FIG. 20) and the circular disk 2006 may be configured based on the location, size, and/or other such properties of the connector bar as described herein.

FIGS. 21 to 24 illustrate a bottom portion (or lower heel) of a retractable heel for use with a shoe with a retractable heel as described in connection with FIGS. 1 and 12 and in accordance with an embodiment. Illustrative views of the lower heel body are shown in FIGS. 21-24. As illustrated in FIGS. 21-24, the lower heel body may include a slot formed within the lower heel body configured to accommodate a portion of a connector bar and further configured to connect the upper heel body and lower heel body as described herein. The lower heel body may include a recessed portion on the top of the lower heel body that may accommodate the bottom portion or any other suitable protrusion of the upper heel body to further secure the attachment of the upper heel body to the lower heel body.

Figure 21:
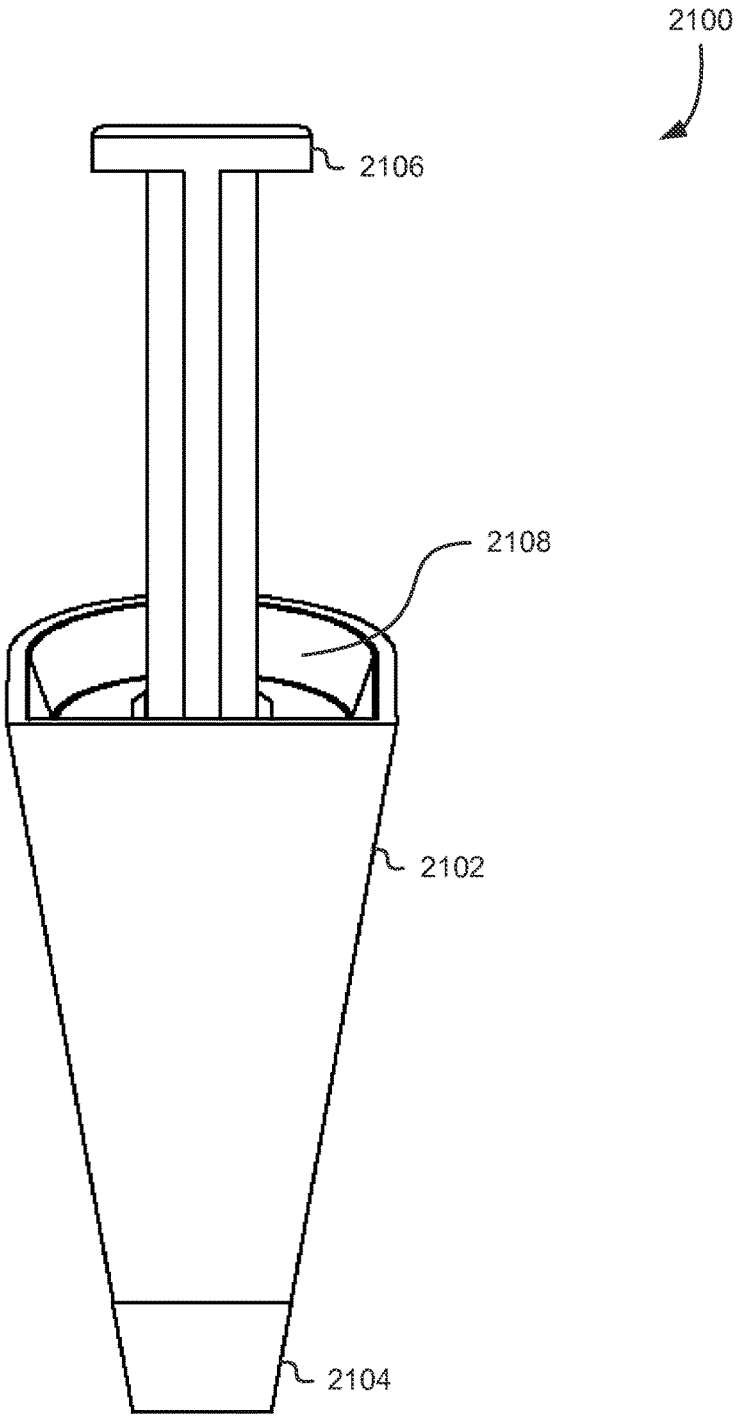
FIG. 21 illustrates a front view of a bottom portion of a retractable heel in accordance with an embodiment.

FIG. 21 illustrates a front view 2100 of a lower heel of a retractable heel for use with a shoe with a retractable heel as described in connection with FIGS. 1 and 12 and in accordance with an embodiment. In the example illustrated in FIG. 21, the lower heel includes a lower heel body 2102, a lower heel striking surface pad 2104, and a connector bar 2106. The connector bar 2106 may extend through the lower heel body 2102 and attach to the lower heel striking surface pad 2104. The connector bar 2106 may attach to the lower heel striking surface pad 2104 using temporary or permanent mechanisms such as those described herein. In some embodiments, the connector bar 2106 may also be attached to the lower heel body 2102 using temporary or permanent mechanisms such as those described herein. As illustrated in FIG. 21, the lower heel body 2102 may include a recessed portion 2108 that may accommodate a corresponding portion of the upper heel body. The recessed portion 2108 may be configured to further secure the lower heel body 2102 when the lower heel body 2102 is in a non-retracted position. The connector bar 2106 illustrated in FIG. 21 may be a T-shaped connector bar as described herein which may be configured to operate in conjunction with a two-part upper heel and/or a two-part circular disk such as the upper heel described in connection with FIGS. 7 to 11.

Figure 22:
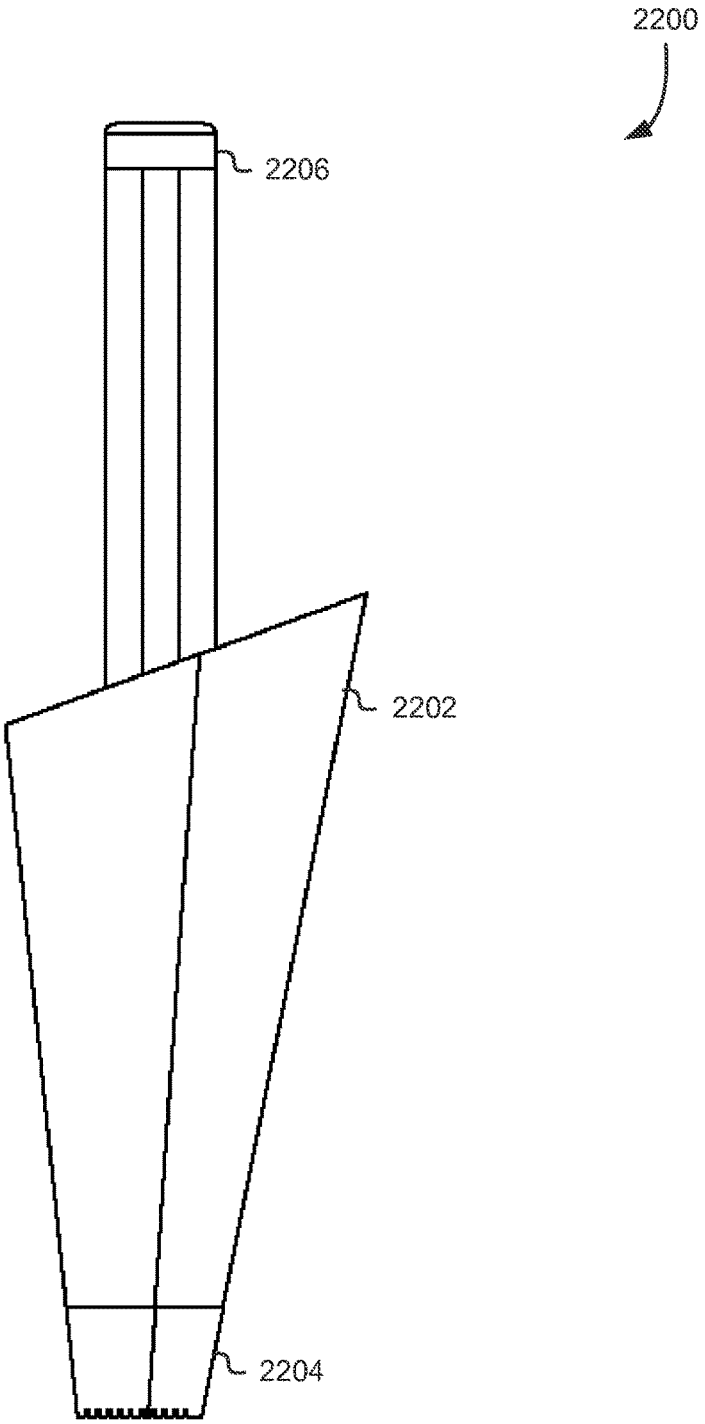
FIG. 22 illustrates a side view of a bottom portion of a retractable heel in accordance with an embodiment.

FIG. 22 illustrates a side view 2200 of the lower heel of a retractable heel described in connection with FIG. 21 and in accordance with an embodiment. The lower heel illustrated in FIG. 22 comprises a lower heel body 2202, a lower heel striking surface pad 2204, and a connector bar 2206.

Figure 23:
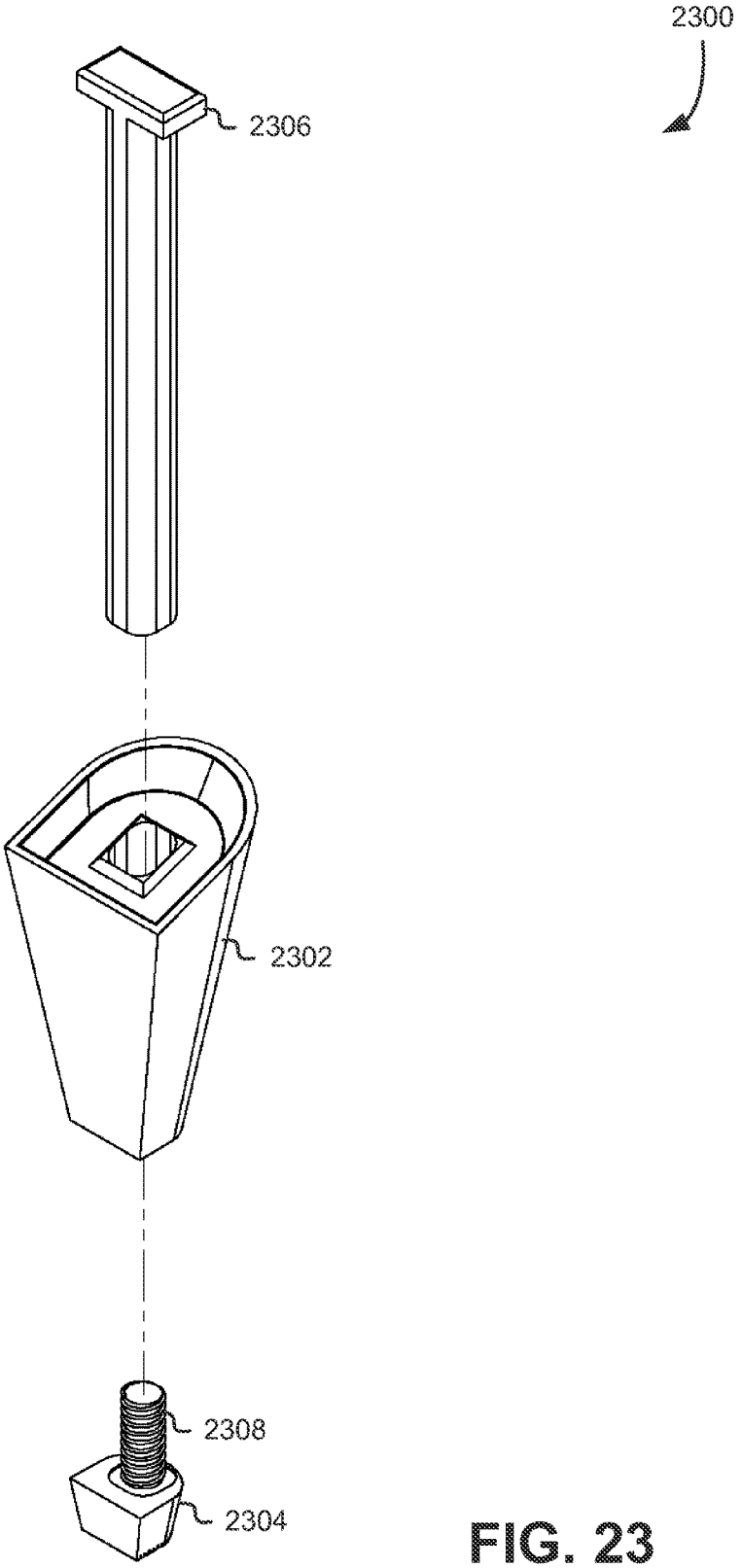
FIG. 23 illustrates an exploded view of a bottom portion of a retractable heel in accordance with an embodiment.

FIG. 23 illustrates an exploded perspective view 2300 of the lower heel of a retractable heel described in connection with FIGS. 21 and 22 and in accordance with an embodiment. The lower heel illustrated in FIG. 23 comprises a lower heel body 2302, a lower heel striking surface pad 2304, and a connector bar 2306. In the example illustrated in FIG. 23, the lower heel striking surface pad 2304 includes a screw 2308 that may be attached into a corresponding threaded portion at the bottom of the connector bar 2306.

Figure 24:
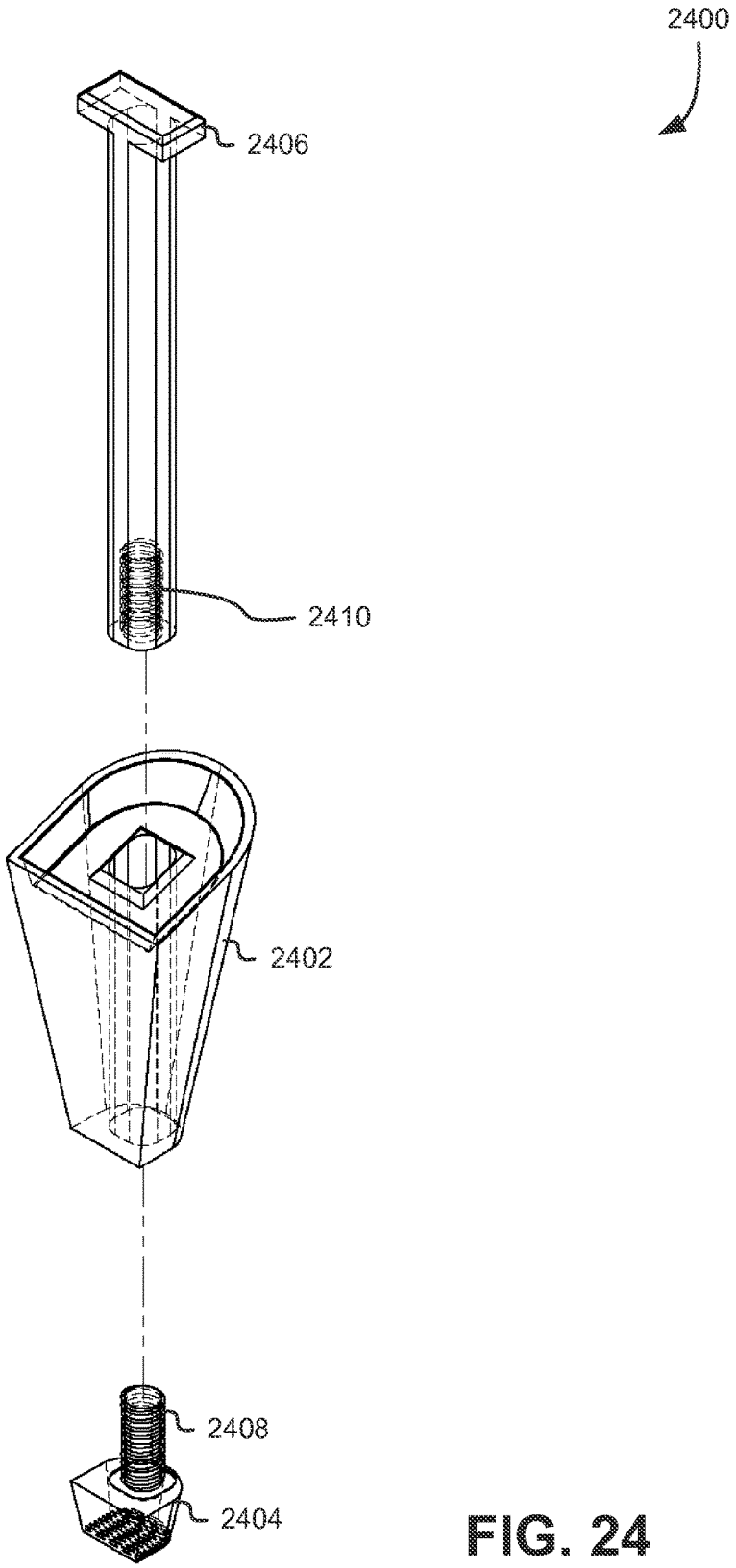
FIG. 24 illustrates an x-ray view of a bottom portion of a retractable heel in accordance with an embodiment.

FIG. 24 illustrates an x-ray view 2400 of the exploded perspective view 2300 of the lower heel of a retractable heel described in connection with FIGS. 21, 22, and 23 and in accordance with an embodiment. The lower heel illustrated in FIG. 24 comprises a lower heel body 2402, a lower heel striking surface pad 2404, and a connector bar 2406. In the example illustrated in FIG. 24, the lower heel striking surface pad 2404 includes a screw 2408 that may be attached into a corresponding threaded portion 2410 at the bottom of the connector bar 2406.

FIGS. 25 to 28 illustrate a lower heel of a retractable heel for use with a shoe with a retractable heel as described in connection with FIGS. 1 and 12 and in accordance with an embodiment.

Figure 25:
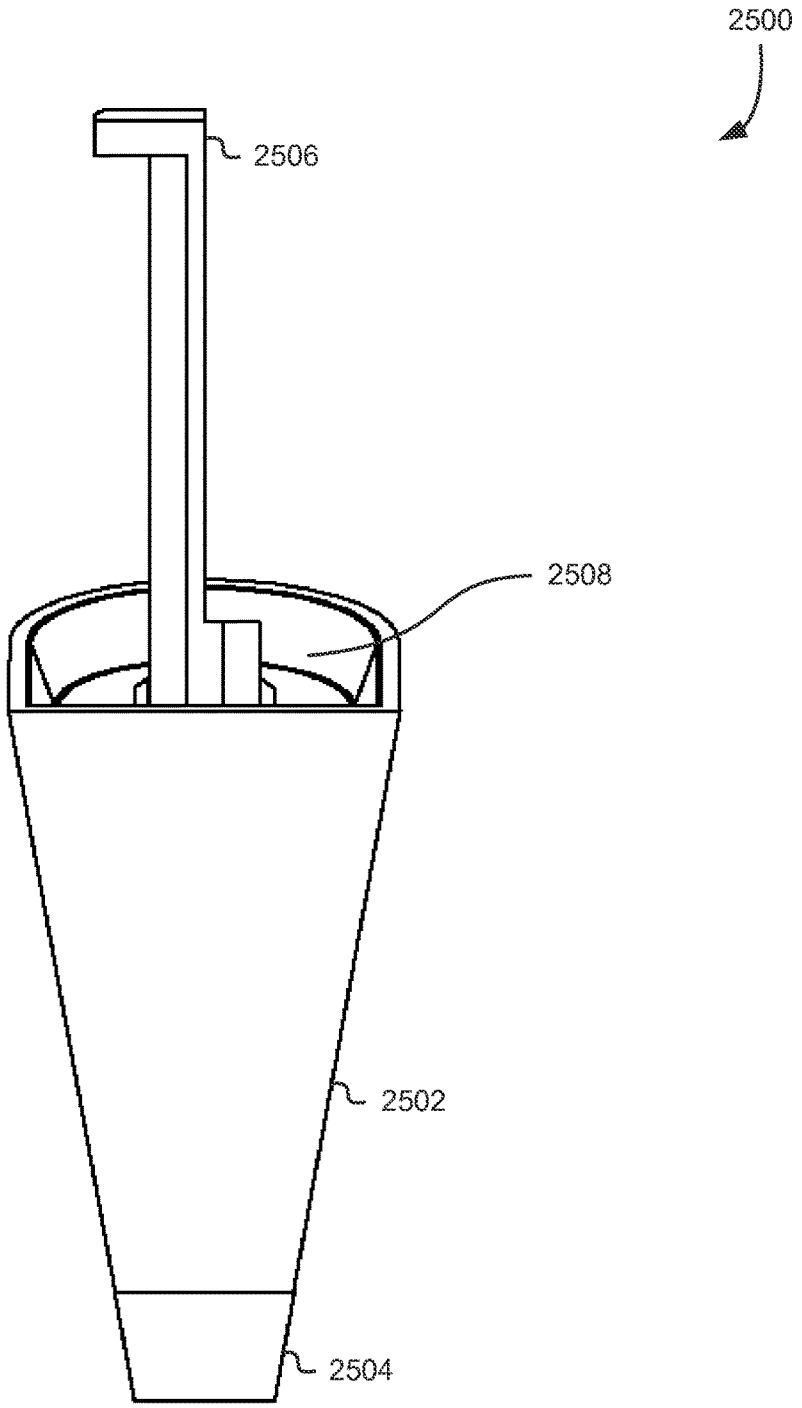
FIG. 25 illustrates a front view of a bottom portion of a retractable heel in accordance with an embodiment.

FIG. 25 illustrates a front view 2500 of a lower heel of a retractable heel for use with a shoe with a retractable heel as described in connection with FIGS. 1 and 12 and in accordance with an embodiment. In the example illustrated in FIG. 25, the lower heel includes a lower heel body 2502, a lower heel striking surface pad 2504, and a connector bar 2506. The lower heel body may be substantially the same as the lower heel body 2102 described in connection with FIG. 21. The lower heel striking surface pad 2504 may also be substantially the same as the lower heel striking surface pad 2104 described in connection with FIG. 21. The connector bar 2506 may extend through the lower heel body 2502 and attach to the lower heel striking surface pad 2504. The connector bar 2506 may attach to the lower heel striking surface pad 2504 using temporary or permanent mechanisms such as those described herein. In some embodiments, the connector bar 2506 may also be attached to the lower heel body 2502 using temporary or permanent mechanisms such as those described herein. As illustrated in FIG. 25, the lower heel body 2502 may include a recessed portion 2508 that may accommodate a corresponding portion of the upper heel body. The recessed portion 2508 may be configured to further secure the lower heel body 2502 when the lower heel body 2502 is in a non-retracted position. The connector bar 2506 illustrated in FIG. 21 may be an L-shaped connector bar as described herein that may be configured to operate in conjunction with an upper heel and/or a circular disk such as the upper heel and circular disk described in connection with FIGS. 18 to 21.

Figure 26:
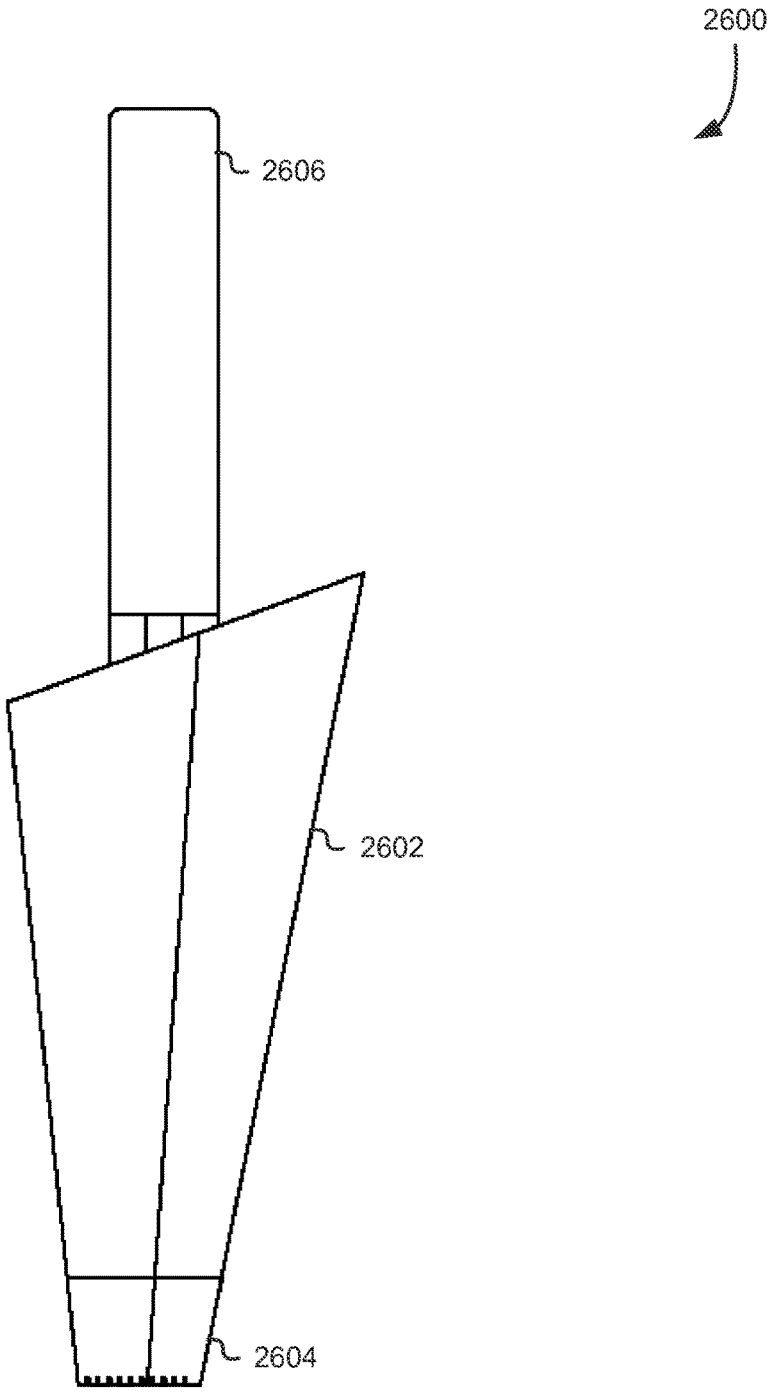
FIG. 26 illustrates a side view of a bottom portion of a retractable heel in accordance with an embodiment.

FIG. 26 illustrates a side view 2600 of the lower heel of a retractable heel described in connection with FIG. 25 and in accordance with an embodiment. The lower heel illustrated in FIG. 26 comprises a lower heel body 2602, a lower heel striking surface pad 2604, and a connector bar 2606.

Figure 27:
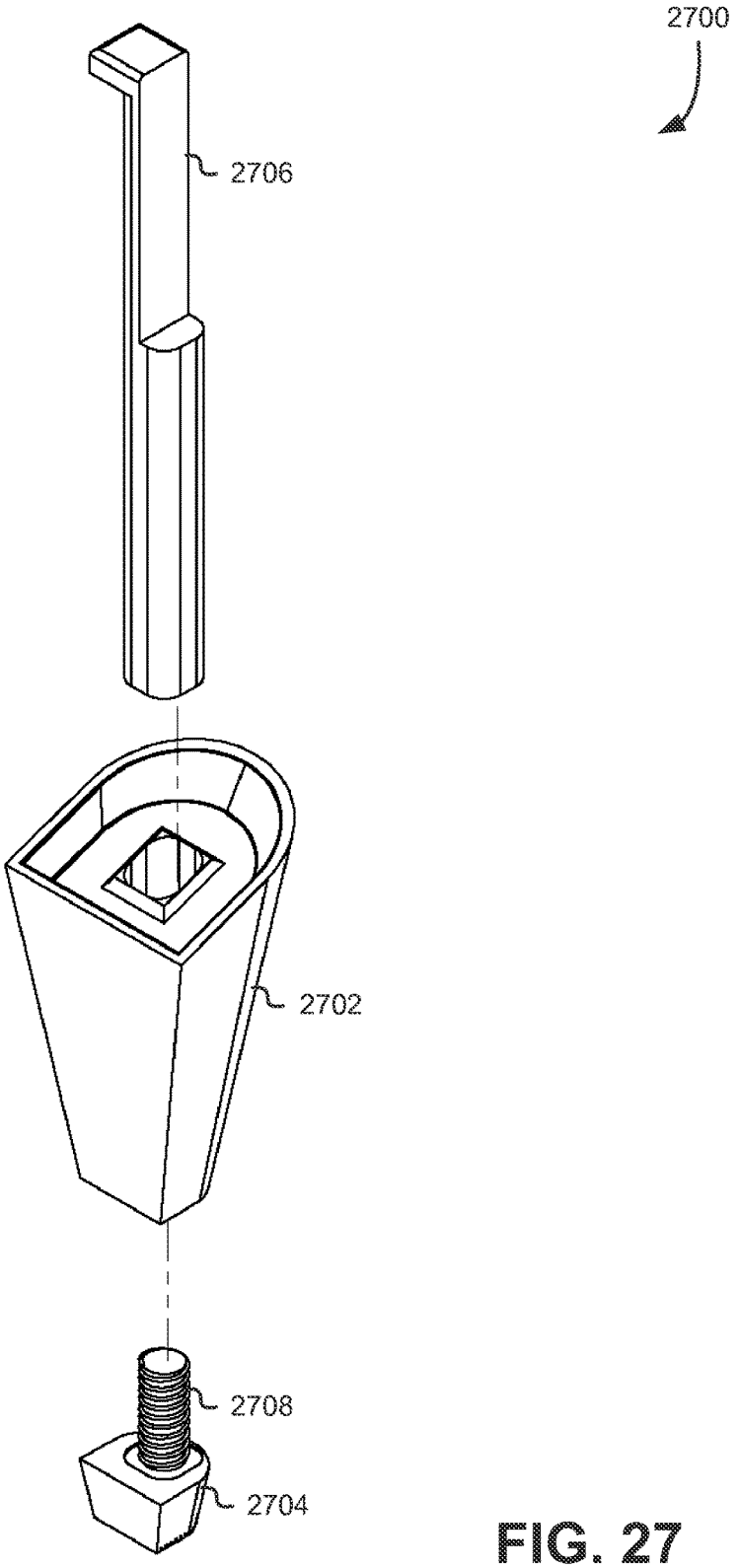
FIG. 27 illustrates an exploded view of a bottom portion of a retractable heel in accordance with an embodiment.

FIG. 27 illustrates an exploded perspective view 2700 of the lower heel of a retractable heel described in connection with FIGS. 25 and 26 and in accordance with an embodiment. The lower heel illustrated in FIG. 27 comprises a lower heel body 2702, a lower heel striking surface pad 2704, and a connector bar 2706. In the example illustrated in FIG. 27, the lower heel striking surface pad 2704 includes a screw 2708 that may be attached into a corresponding threaded portion at the bottom of the connector bar 2706.

Figure 28:
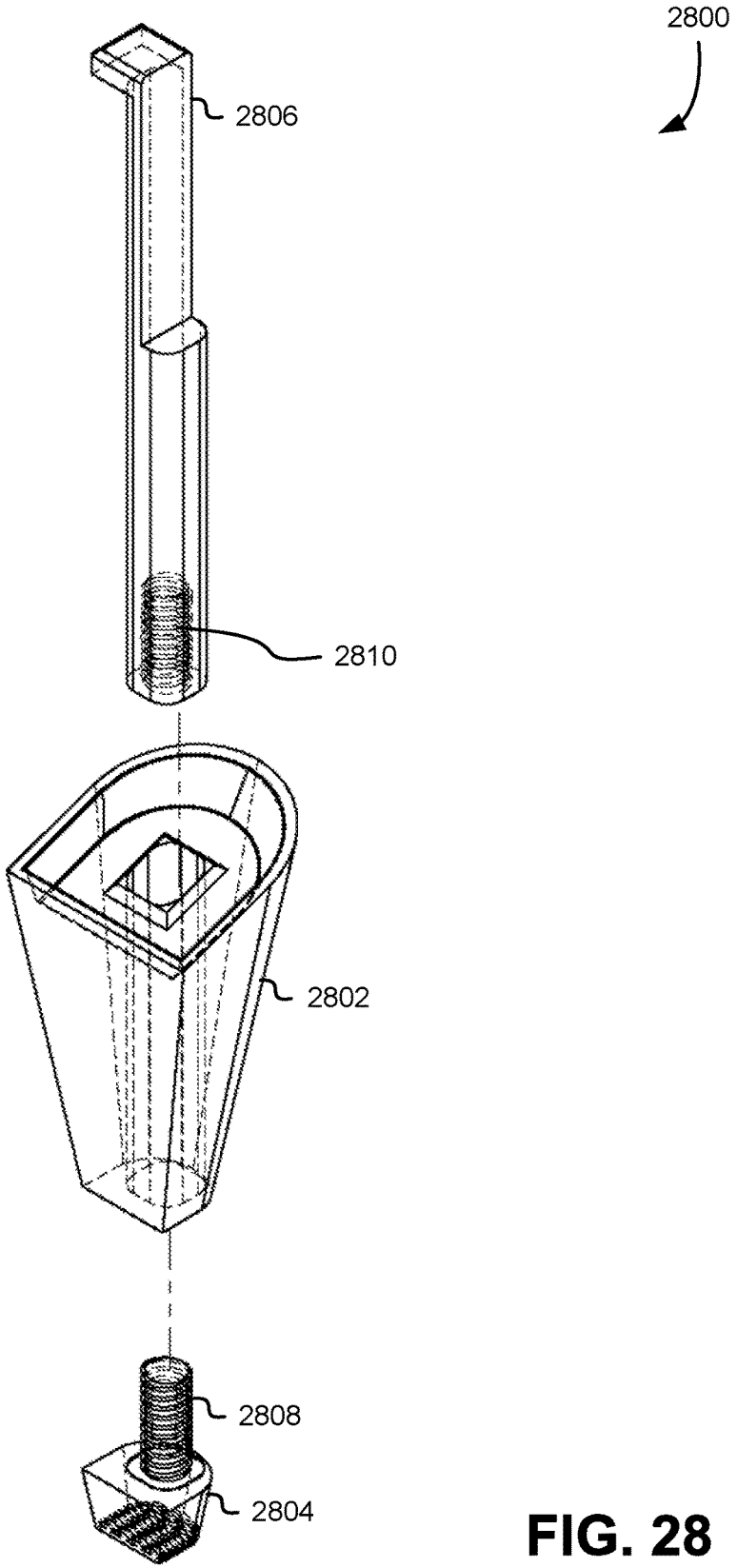
FIG. 28 illustrates an x-ray view of a bottom portion of a retractable heel in accordance with an embodiment.

FIG. 28 illustrates an x-ray view 2800 of the exploded perspective view 2700 of the lower heel of a retractable heel described in connection with FIGS. 25, 26, and 27 and in accordance with an embodiment. The lower heel illustrated in FIG. 28 comprises a lower heel body 2802, a lower heel striking surface pad 2804, and a connector bar 2806. In the example illustrated in FIG. 28, the lower heel striking surface pad 2804 includes a screw 2808 (corresponding to the screw 2408 described in connection with FIG. 24) that may be attached into a corresponding threaded portion 2810 (corresponding to the threaded portion 2410 described in connection with FIG. 24) at the bottom of the connector bar 2806.

FIGS. 29 to 32 illustrate examples of a connector bar of a retractable heel for use with a shoe with a retractable heel as described in connection with FIGS. 1 and 12 and in accordance with an embodiment. As described herein, the connector bar may be T-shaped, may be L-shaped, or may be some other suitable shape. For example, a T-shaped connector bar may include a bar portion with two protrusions on the top while an L-shaped bar may include a bar portion with one protrusion on the top. A connector bar may generally include a bar portion and a protrusion portion, where the protrusion portion is wider than the bar portion in one or more dimensions, and may have protrusions in one or more directions in each of the one or more dimensions. The connector bar may include one or more cross-sections that may be square, rectangular, circular, triangular, or some other such cross-section shape. A connector bar may also include one or more holes, cutout portions, cutout sub-portions, or any other suitable region for attaching a connector bar to lower heel body and/or to an upper heel body. For example, a connector bar may include a hole formed at an end of the bar portion to allow attachment to a lower heel body. In a more particular example, when forming a lower heel body of the adjustable heel (e.g., using an injection molding process with high-density polyethylene), the high-density polyethylene or any other suitable polymeric material can be formed around the connector bar and through one or more holes at the end of the bar portion. This process of molding the lower heel body around the connector bar may include other molding processes such as, for example, molding design elements into the lower heel body. Holes and other suitable elements on the connector bar and/or in other elements of the retractable heel may be used to promote attachment of the lower heel body to the connector bar.

Figure 29:
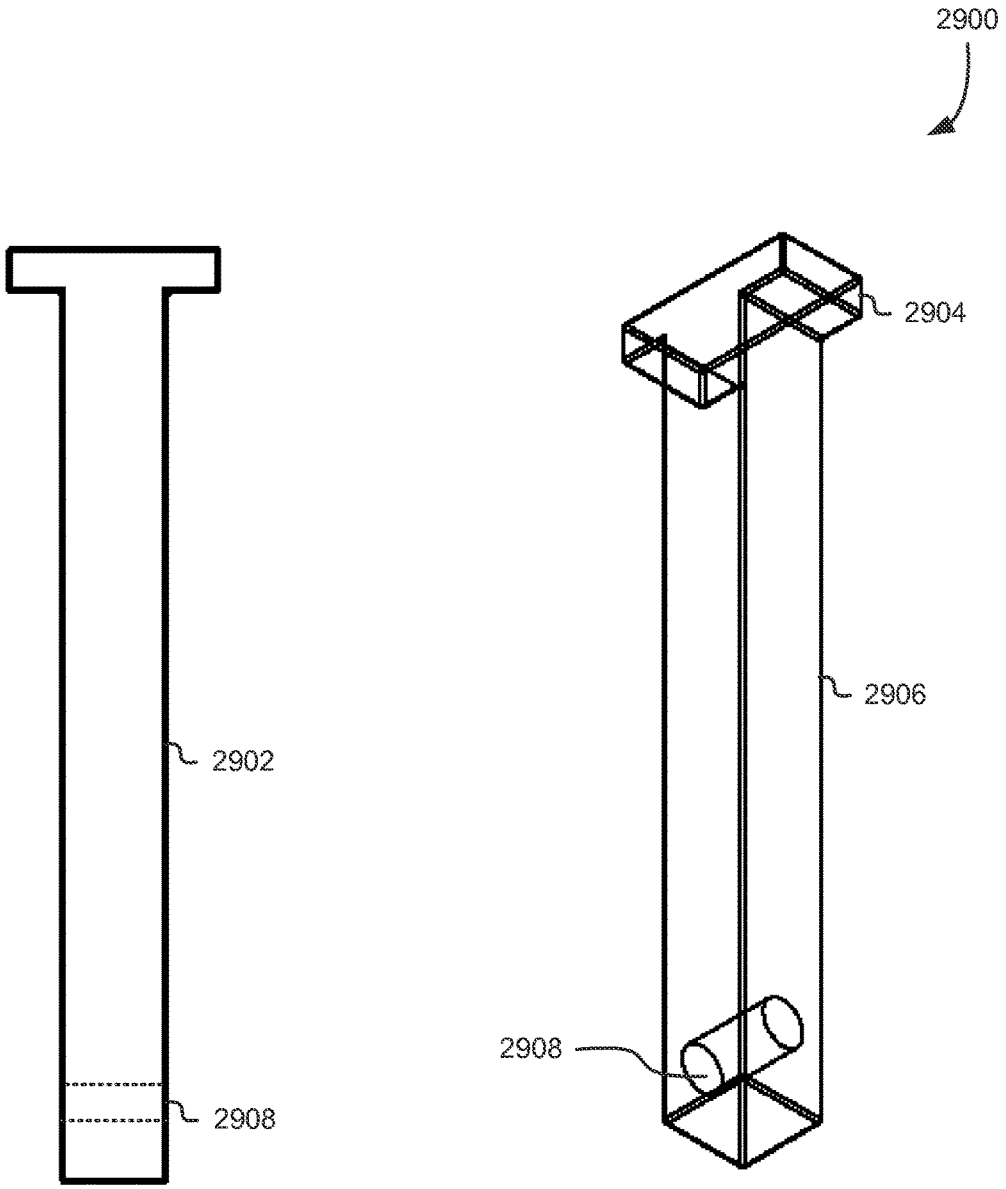
FIG. 29 illustrates a front view and an x-ray view of a connector bar in accordance with an embodiment.

FIG. 29 illustrates two views 2900 of an example of a connector bar for use with a shoe with a retractable heel as described in connection with FIGS. 1 and 12 and in accordance with an embodiment. The connector bar 2902 illustrated in FIG. 29 is a T-shaped connector bar with two protrusions 2904 at the top part of the bar and with a square cross-section 2906 in the bar portion of the connector bar. The connector bar 2902 illustrated in FIG. 29 includes a hole 2908 oriented laterally through the bar portion of the connector bar that may be used to attach the connector bar 2902 to a lower heel body as described herein. In some embodiments, the hole 2908 may be a threaded hole and/or may be one of a plurality of such attachment holes.

Figure 30:
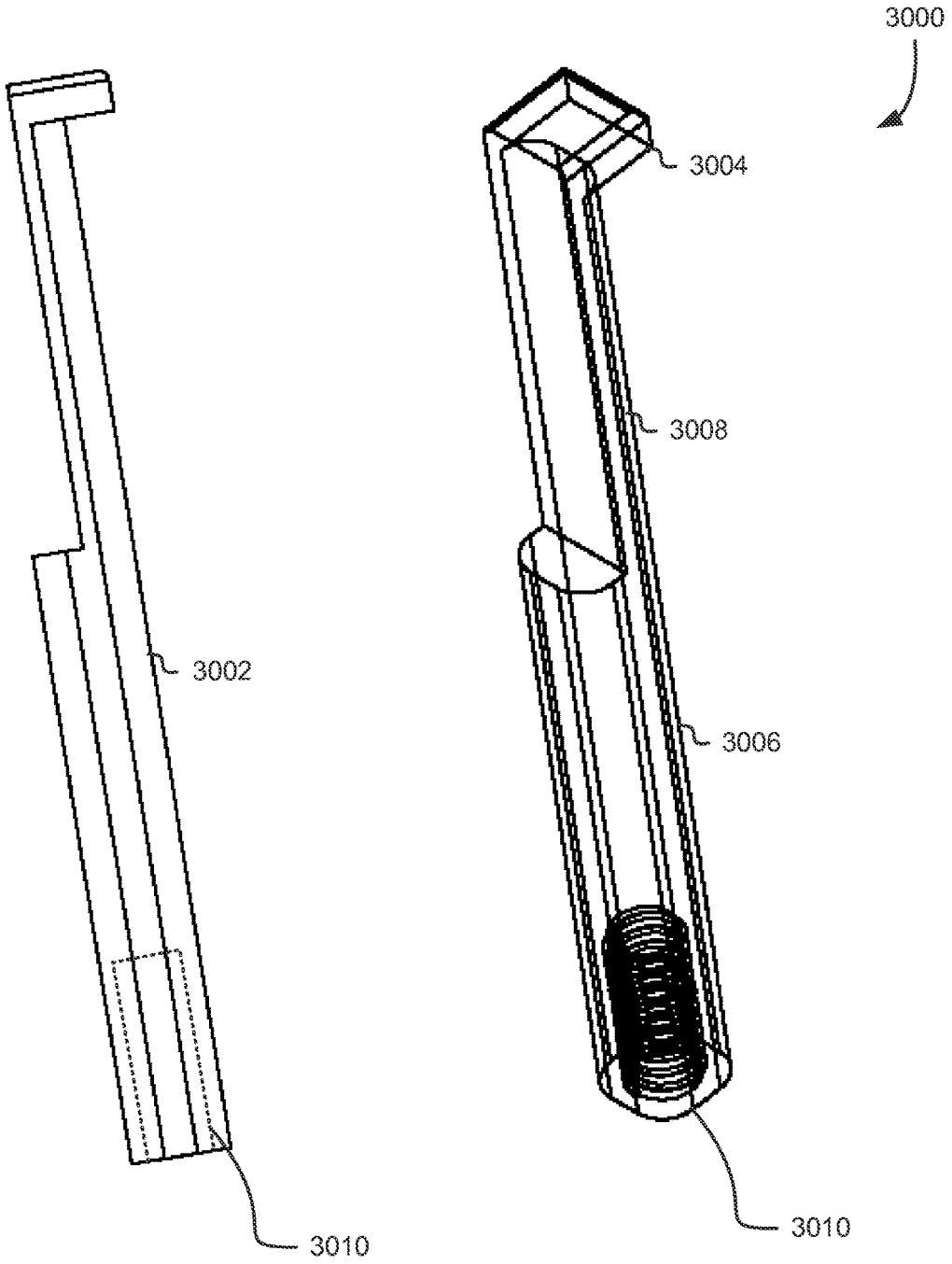
FIG. 30 illustrates a front view and an x-ray view of a connector bar in accordance with an embodiment.

FIG. 30 illustrates two views 3000 of an example of a connector bar for use with a shoe with a retractable heel as described in connection with FIGS. 1 and 12 and in accordance with an embodiment. The connector bar 3002 illustrated in FIG. 30 is an L-shaped connector bar with one protrusion 3004 at the top part of the bar, with a rounded octagonal cross-section 3006 in the lower bar portion of the connector bar, and with a half of a rounded octagonal cross-section 3008 in the upper bar portion. The connector bar 3002 illustrated in FIG. 30 includes a hole 3010 oriented through the bottom of the bar portion of the connector bar that may be used to attach the connector bar 3002 to a lower heel body as described herein. In some embodiments, as illustrated in FIG. 30, the hole 3010 may be a threaded hole and/or may be one of a plurality of such attachment holes.

Figure 31:
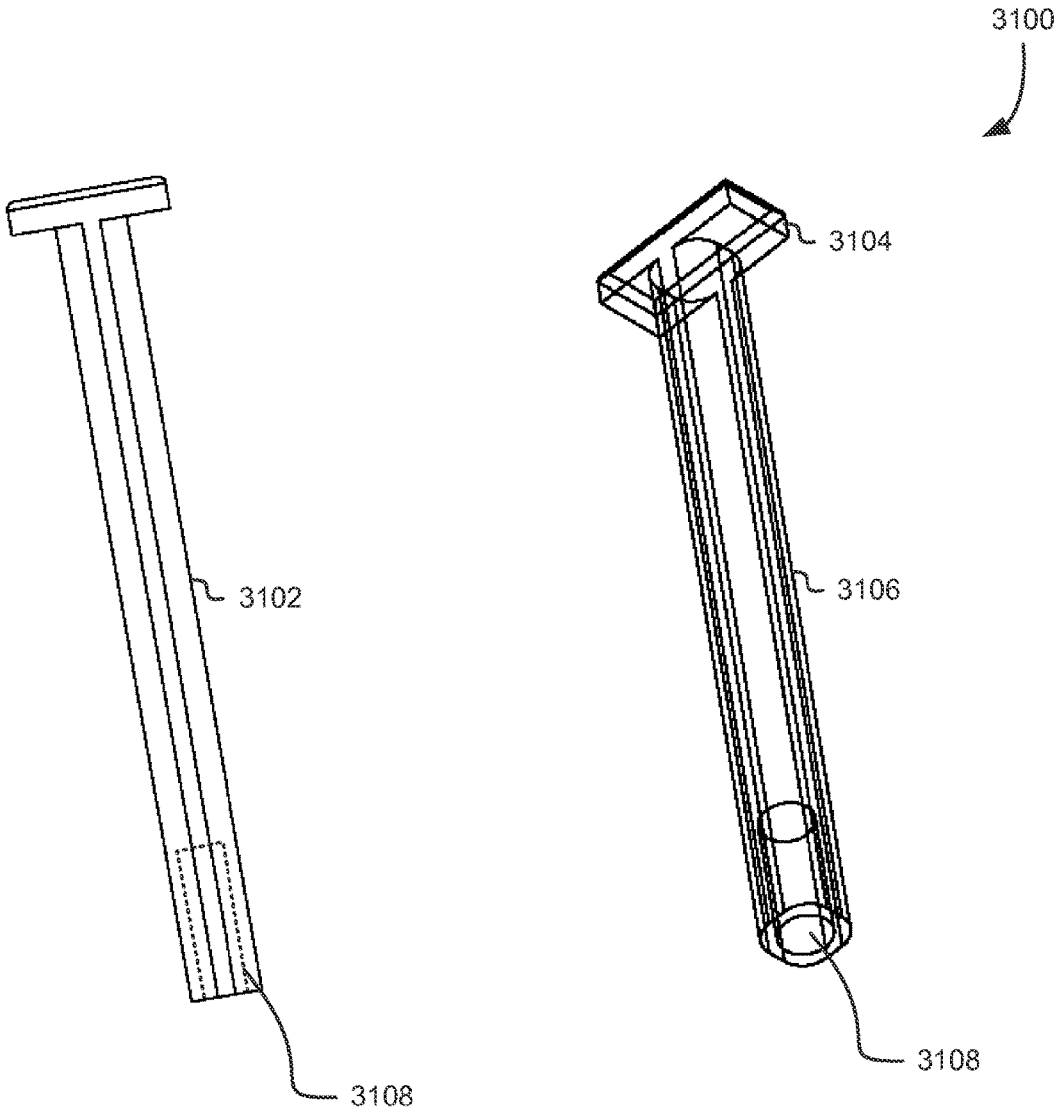
FIG. 31 illustrates a front view and an x-ray view of a connector bar in accordance with an embodiment.

FIG. 31 illustrates two views 3100 of an example of a connector bar for use with a shoe with a retractable heel as described in connection with FIGS. 1 and 12 and in accordance with an embodiment. The connector bar 3102 illustrated in FIG. 31 is a T-shaped connector bar with two protrusions 3104 at the top part of the bar and with a rounded octagonal cross-section 3106 in the bar portion of the connector bar. The connector bar 3102 illustrated in FIG. 31 includes a hole 3108 oriented through the bottom of the bar portion of the connector bar that may be used to attach the connector bar 3102 to a lower heel body as described herein. In some embodiments, the hole 3108 may be a threaded hole and/or may be one of a plurality of such attachment holes.

Figure 32:
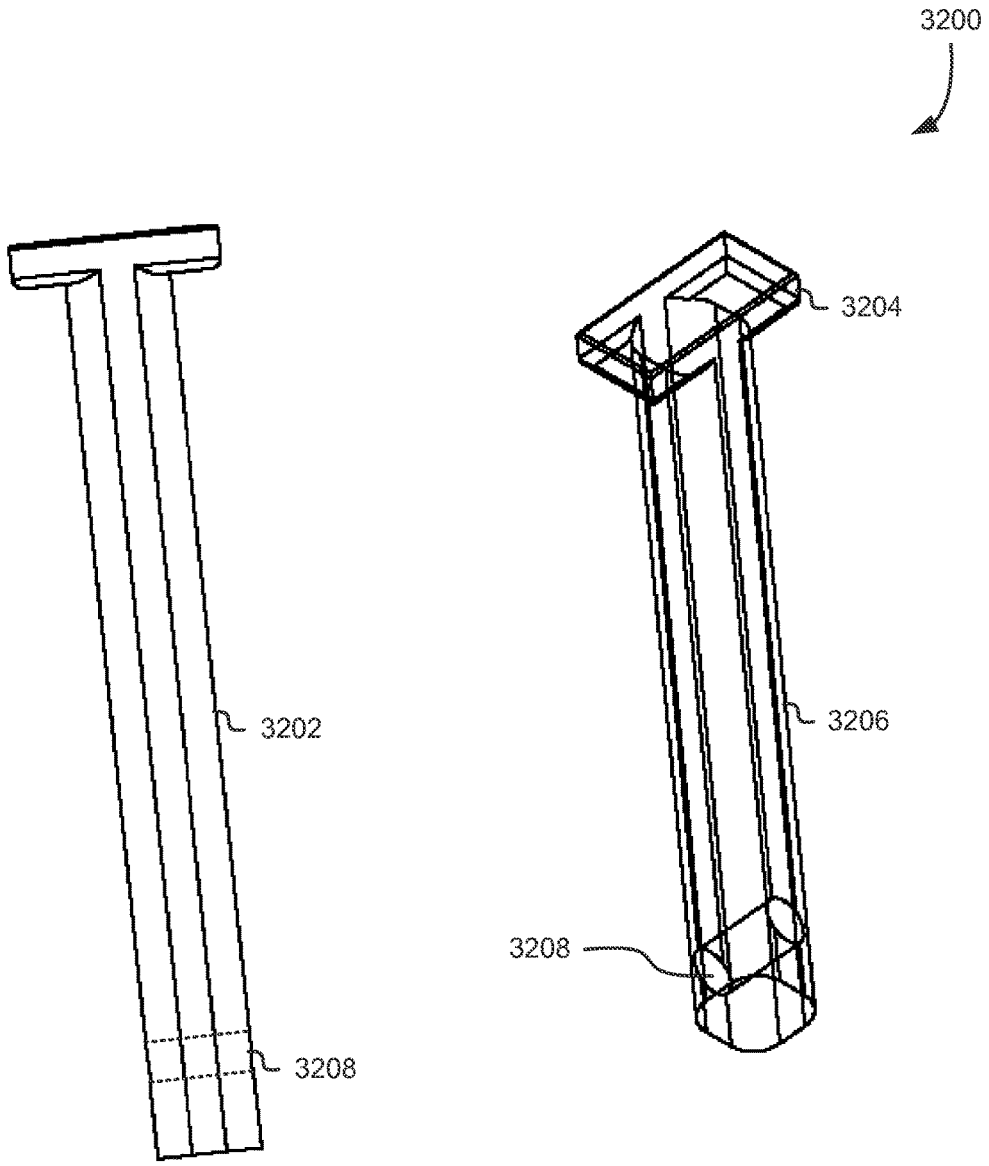
FIG. 32 illustrates a front view and an x-ray view of a connector bar in accordance with an embodiment.

FIG. 32 illustrates two views 3200 of an example of a connector bar for use with a shoe with a retractable heel as described in connection with FIGS. 1 and 12 and in accordance with an embodiment. The connector bar 3202 illustrated in FIG. 32 is a T-shaped connector bar with two protrusions 3204 at the top part of the bar and with an octagonal cross-section 3206 in the bar portion of the connector bar. The connector bar 3202 illustrated in FIG. 32 includes a hole 3208 oriented laterally through the bar portion of the connector bar that may be used to attach the connector bar 3202 to a lower heel body as described herein. In some embodiments, the hole 3208 may be a threaded hole and/or may be one of a plurality of such attachment holes.

FIG. 33 illustrates a side view 3300 of a compressible spring which may be used with a connector bar for use with a shoe with a retractable heel as described in connection with FIGS. 1 and 12 and in accordance with an embodiment. The compressible spring is shown with a rest configuration that is an uncompressed or non-compressed configuration 3302. The compressible spring is also shown in a partially compressed configuration 3304 and in a fully compressed configuration 3306. The partially compressed configuration 3304 and the fully compressed configuration 3306 may result from applying force to the spring in a direction indicated by the arrow 3308.

In some embodiments, the rest state of the spring may be similar to the partially compressed configuration 3304 or the fully compressed configuration 3306. In such embodiments, the spring may be referred to as an expandable spring. An expandable spring may be expanded from the fully compressed configuration 3306 to the partially compressed configuration 3304 and/or from the partially compressed configuration 3304 to the non-compressed configuration 3302 by applying a force to the spring in a direction indicated by the arrow 3310.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the invention as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including" and "containing" are to be construed as open-ended terms (i.e., meaning "including, but not limited to,") unless otherwise noted. The term "connected," when unmodified and referring to physical connections, is to be construed as partly or wholly contained within, attached to or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of the term "set" (e.g., "a set of items") or "subset," unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," unless specifically stated otherwise or otherwise clearly contradicted by context, is otherwise understood with the context as used in general to present that an item, term, etc., may be either A or B or C, or any nonempty subset of the set of A and B and C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present.

The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described herein, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described herein. Accordingly, the scope of the present disclosure includes all modifications and equivalents of the subject matter recited in the claims appended hereto as permitted by applicable law. Moreover, any combination of the above-described elements in all possible variations thereof is encompassed by the scope of the present disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A heel for a shoe, comprising:

an upper heel body comprising:

a right upper heel body with a right upper heel body extension; and a left upper heel body with a left upper heel body extension, the left upper heel body connected to the right upper heel body;

a pivoting connector located in a pivot indentation in the upper heel body, the pivot indentation located between the right upper heel body and the left upper heel body, the pivot indentation including a plurality of retention slots located on a perimeter of the pivot indentation;

a lower heel body affixed to a second end of a connector bar, the connector bar moveably affixed to the pivoting connector, the connector bar being a T-shaped connector bar at least comprising a bar portion and a plurality of protrusions, the plurality of protrusions located at a first end of the connector bar, the connector bar moveable within the pivoting connector, allowing the first end of the connector bar to be located within one or more retention slots of the plurality of retention slots;

a plurality of springs, the plurality of springs included within the pivoting connector, the plurality of springs oriented such that each spring of the plurality of springs is moveably attached to a corresponding protrusion of the plurality of protrusions of the connector bar, each spring of the plurality of springs being in a compressed configuration when the lower heel body is pulled away from the upper heel body, each spring of the plurality of springs in an at least partially compressed configuration when the first end of the connector bar is located within the one or more retention slots of the plurality of retention slots, each spring of the plurality of springs securing a corresponding protrusion of the plurality of protrusions of the connector bar within the one or more retention slots of the plurality of retention slots when in the at least partially compressed configuration, the plurality of springs oriented substantially parallel to the bar portion of the connector bar, the plurality of the springs located substantially adjacent to the bar portion of the connector bar;

an upper heel striking surface located at a bottom portion of the upper heel body; and the lower heel body movably connected with the upper heel body at the bottom portion of the upper heel body using the connector bar such that the heel has at least two configurations, the at least two configurations comprising:

a first configuration where the upper heel striking surface is prevented from striking a terrain surface by the lower heel body; and a second configuration wherein:

the upper heel striking surface is able to hit the terrain surface; and the lower heel body is at least partially obscured by the right upper heel body extension and the left upper heel body extension.

2. The heel for the shoe of claim 1, wherein:

the connector bar is located between the right upper heel body and the left upper heel body; and a protrusion portion of the connector bar is wider in one or more dimensions than the bar portion of the connector bar.

3. The heel for the shoe of claim 2, wherein the lower heel body is affixed to the connector bar by molding the lower heel body around the connector bar.

4. The heel for the shoe of claim 1, wherein the lower heel body comprises a lower heel striking surface pad, the lower heel striking surface pad comprising a pad portion and a connector portion such that the connector portion of the lower heel striking surface pad affixes the lower heel body to the connector bar.

5. The heel for the shoe of claim 4, wherein:

the connector bar further comprises a threaded end opposite the first end; and the connector portion of the lower heel striking surface pad affixes the lower heel body to the connector by screwing the connector portion onto the threaded end of the connector bar.

6. The heel for the shoe of claim 1, wherein the pivot indentation is a circular indentation.

7. The heel for the shoe of claim 1, wherein the pivoting connector is a circular disk.

8. The heel for the shoe of claim 7, wherein the connector bar pivots around a point approximately at the center of rotation of the circular disk as the circular disk rotates.

9. The heel for the shoe of claim 8, wherein a cutout portion through the circular disk is narrower than a wider portion of the connector bar.

10. The heel for the shoe of claim 1, wherein, in the second configuration, the lower heel body is fully obscured by the right upper heel body extension and the left upper heel body extension.

11. The heel for the shoe of claim 1, wherein the plurality of retention slots at least includes a first retention slot corresponding to the first configuration and a second retention slot corresponding to the second configuration.

12. The heel for the shoe of claim 11, wherein the pivot indentation includes a pivot slot located on the perimeter of the pivot indentation in the upper heel body, the pivot slot comprising an arc, the arc at least including a starting location diametrically opposed to the first retention slot and an ending location diametrically opposed to the second retention slot.

13. The heel for the shoe of claim 1, wherein the pivoting connector includes one or more magnets, the one or more magnets securing the plurality of protrusions of the connector bar within the one or more retention slots of the plurality of retention slots.

14. The heel for the shoe of claim 1, wherein the pivoting connector includes a cutout portion from a first perimeter location on the pivoting connector to a second perimeter location on the pivoting connector.

15. The heel for the shoe of claim 14, wherein the cutout portion comprises:

a first cutout sub-portion located at the first perimeter location; and a second cutout sub-portion extending from the first cutout sub-portion, to the second perimeter location, wherein the second cutout sub-portion is narrower than the first cutout sub-portion in one or more dimensions.

16. The heel for the shoe of claim 15, wherein the connector bar is located within the cutout portion such that the first end is located within the first cutout sub-portion and at least a part of the bar portion is located within the second cutout sub-portion.

17. The heel for the shoe of claim 1, wherein the upper heel striking surface comprises an upper heel striking surface pad, the upper heel striking surface pad permitting movement of the pivoting connector.

18. The heel for the shoe of claim 1, wherein the lower heel body being movably connected with the upper heel body at the bottom portion of the upper heel body comprises retracting the lower heel body into the upper heel body.

19. The heel for the shoe of claim 1, wherein the pivoting connector includes a metallic element on the end of the connector bar.

20. The heel for the shoe of claim 1, wherein the pivoting connector includes a resistive force to retain the connecter bar in a retention slot of the plurality of retention slots.

* * * * *